US005117258A

United States Patent [19]

Iwata

[11] Patent Number: 5,117,258

[45] Date of Patent: May 26, 1992

[54] APPARATUS WITH COPYING FEE BASED ON SIZE AND NUMBER OF SHEETS USED

[75] Inventor: Yasuhiro Iwata, Kanagawa, Japan

[73] Assignee: Kabushiki Kaisha Toshiba, Kawasaki, Japan

[21] Appl. No.: 440,114

[22] Filed: Nov. 22, 1989

[30] Foreign Application Priority Data

| | | | |
|---|---|---|---|
| Dec. 13, 1988 | [JP] | Japan | 63-314594 |
| Dec. 26, 1988 | [JP] | Japan | 63-325872 |
| Dec. 26, 1988 | [JP] | Japan | 63-325875 |
| Dec. 26, 1988 | [JP] | Japan | 63-325879 |
| Dec. 26, 1988 | [JP] | Japan | 63-325886 |

[51] Int. Cl.[5] ..... G03G 21/00

[52] U.S. Cl. ..... 355/201; 355/308; 355/311

[58] Field of Search ..... 355/201, 202, 308, 311, 355/200; 377/8, 13; 364/464.01, 464.04

[56] References Cited

U.S. PATENT DOCUMENTS

| | | | |
|---|---|---|---|
| 3,655,281 | 4/1972 | Warren | 355/311 X |
| 3,971,919 | 7/1976 | Fantozzi | 355/308 X |
| 3,989,930 | 11/1976 | Sohm | 355/311 X |
| 4,586,034 | 4/1986 | Nakamine | 340/679 |
| 4,707,111 | 11/1987 | Inuzuka et al. | 355/311 |

FOREIGN PATENT DOCUMENTS

| | | | |
|---|---|---|---|
| 0156055 | 7/1986 | Japan | 355/308 |
| 0096963 | 5/1987 | Japan | 355/308 |
| 0096969 | 5/1987 | Japan | 355/201 |
| 0121856 | 5/1988 | Japan | 355/201 |
| 2162467 | 2/1986 | United Kingdom | 355/202 |

*Primary Examiner*—A. T. Grimley
*Assistant Examiner*—William J. Royer
*Attorney, Agent, or Firm*—Foley & Lardner

[57] ABSTRACT

An image forming apparatus includes a plurality of cassettes which store paper sheets of different sizes and a feeding device for feeding the paper sheets one by one. The image forming apparatus forms an image on the paper sheet fed by the feeding device. A size detector detects the size of the paper sheet which is used. A copying fee is calculated based on the size and number of the sheets used.

2 Claims, 34 Drawing Sheets

| NAME | SIZE | NUMBER | FEE |
|---|---|---|---|
| ABCD | LEDGER | 1000 | $ 130 |
| | COMPUTER | 1000 | $ 130 |
| | LEGAL | 5000 | $ 300 |
| | LETTER | 0100 | $ 100 |
| | STATEMENT | 0030 | $ 30 |
| | SUM | 8500 | $ 690 |
| EFGH | LEDGER | 0010 | $ 1.3 |
| | COMPUTER | 0000 | $ 0 |
| | LEGAL | 1000 | $ 60 |
| | LETTER | 0000 | $ 0 |
| | STATEMENT | 0000 | $ 0 |
| | SUM | 1010 | $ 61.3 |

401 323 402

| | | | | | |
|---|---|---|---|---|---|
| 401a | PIN A | PIN B | PIN C | OPERATOR CODE | 402a |
| 401b | LEDGER | LEDGER | LEDGER | FEE FOR LEDGER | 402b |
| 401c | COMPUTER | COMPUTER | COMPUTER | FEE FOR COMPUTER | 402c |
| 401d | LEGAL | LEGAL | LEGAL | FEE FOR LEGAL | 402d |
| 401e | LETTER | LETTER | LETTER | FEE FOR LETTER | 402e |
| 401f | STATEMENT | STATEMENT | STATEMENT | FEE FOR STATEMENT | 402f |
| 401g | OTHER | OTHER | OTHER | FEE FOR OTHERS | 402g |
| 401h | SUM | SUM | SUM | | |
| | PIN D | PIN E | PIN F | | |
| | LEDGER | LEDGER | LEDGER | | |
| | COMPUTER | COMPUTER | COMPUTER | | |
| | LEGAL | LEGAL | LEGAL | | |
| | LETTER | LETTER | LETTER | | |
| | STATEMENT | STATEMENT | STATEMENT | | |
| | OTHER | OTHER | OTHER | | |
| | SUM | SUM | SUM | | |
| | PIN G | PIN H | PIN I | | |
| | LEDGER | LEDGER | LEDGER | | |
| | COMPUTER | COMPUTER | COMPUTER | | |
| | LEGAL | LEGAL | LEGAL | | |
| | LETTER | LETTER | LETTER | | |
| | STATEMENT | STATEMENT | STATEMENT | | |
| | OTHER | OTHER | OTHER | | |
| | SUM | SUM | SUM | | |
| | ⋮ | ⋮ | ⋮ | | |

Fig.10.

| | 405 | 407 |
|---|---|---|
| LEDGER | 1000 | $ 130 |
| COMPUTER | 1000 | $ 130 |
| LEGAL | 5000 | $ 300 |
| LETTER | 1000 | $ 100 |
| STATEMENT | 500 | $ 30 |
| SUM | 8500 | $ 690 |

129

Fig.17.

| | |
|---|---|
| LEDGER | 1000 |
| COMPUTER | 1000 |
| LEGAL | 5000 |
| LETTER | 1000 |
| STATEMENT | 500 |
| SUM | 8500 |

129

Fig.18.

| PIN | SIZE | NUMBER | FEE |
|---|---|---|---|
| 1111 | LEDGER | 1000 | $ 130 |
| | COMPUTER | 1000 | $ 130 |
| | LEGAL | 5000 | $ 300 |
| | LETTER | 0100 | $ 100 |
| | STATEMENT | 0030 | $ 30 |
| | SUM | 8500 | $ 690 |
| 2222 | LEDGER | 0010 | $ 1.3 |
| | COMPUTER | 0000 | $ 0 |
| | LEGAL | 1000 | $ 60 |
| | LETTER | 0000 | $ 0 |
| | STATEMENT | 0000 | $ 0 |
| | SUM | 1010 | $ 61.3 |

Fig. 20.

| PIN | SIZE | NUMBER |
|---|---|---|
| 1111 | LEDGER | 1000 |
| | COMPUTER | 1000 |
| | LEGAL | 5000 |
| | LETTER | 0100 |
| | STATEMENT | 0030 |
| | SUM | 8500 |
| 2222 | LEDGER | 0010 |
| | COMPUTER | 0000 |
| | LEGAL | 1000 |
| | LETTER | 0000 |
| | STATEMENT | 0000 |
| | SUM | 1010 |

Fig. 21.

| NAME | SIZE | NUMBER | FEE |
|---|---|---|---|
| ABCD | LEDGER | 1000 | $ 130 |
| | COMPUTER | 1000 | $ 130 |
| | LEGAL | 5000 | $ 300 |
| | LETTER | 0100 | $ 100 |
| | STATEMENT | 0030 | $ 30 |
| | SUM | 8500 | $ 690 |
| EFGH | LEDGER | 0010 | $ 1.3 |
| | COMPUTER | 0000 | $ 0 |
| | LEGAL | 1000 | $ 60 |
| | LETTER | 0000 | $ 0 |
| | STATEMENT | 0000 | $ 0 |
| | SUM | 1010 | $ 61.3 |

Fig. 22.

701

PIN A — 703

LEDGER

COPYING FEE PER ONE COPY,
COPYING FEE
NUMBER OF USED PAPER SHEETS
AT THE PRESENT COPYING TIME
TOTAL NUMBER OF USED PAPER SHEETS — 705

COMPUTER

COPYING FEE PER ONE COPY,
COPYING FEE
NUMBER OF USED PAPER SHEETS
AT THE PRESENT COPYING TIME
TOTAL NUMBER OF USED PAPER SHEETS — 707

LEGAL

COPYING FEE PER ONE COPY,
COPYING FEE
NUMBER OF USED PAPER SHEETS
AT THE PRESENT COPYING TIME
TOTAL NUMBER OF USED PAPER SHEETS — 709

LETTER

COPYING FEE PER ONE COPY,
COPYING FEE
NUMBER OF USED PAPER SHEETS
AT THE PRESENT COPYING TIME
TOTAL NUMBER OF USED PAPER SHEETS — 711

STATEMENT

COPYING FEE PER ONE COPY,
COPYING FEE
NUMBER OF USED PAPER SHEETS
AT THE PRESENT COPYING TIME
TOTAL NUMBER OF USED PAPER SHEETS — 713

MEMO

715

Fig. 35.

809

| | |
|---|---|
| LEDGER<br>COPYING FEE PER ONE COPY,<br>COPYING FEE<br>NUMBER OF USED PAPER SHEETS<br>AT THE PRESENT COPYING TIME<br>TOTAL NUMBER OF USED PAPER SHEETS | 817 |
| COMPUTER<br>COPYING FEE PER ONE COPY,<br>COPYING FEE<br>NUMBER OF USED PAPER SHEETS<br>AT THE PRESENT COPYING TIME<br>TOTAL NUMBER OF USED PAPER SHEETS | 819 |
| LEGAL<br>COPYING FEE PER ONE COPY,<br>COPYING FEE<br>NUMBER OF USED PAPER SHEETS<br>AT THE PRESENT COPYING TIME<br>TOTAL NUMBER OF USED PAPER SHEETS | 821 |
| LETTER<br>COPYING FEE PER ONE COPY,<br>COPYING FEE<br>NUMBER OF USED PAPER SHEETS<br>AT THE PRESENT COPYING TIME<br>TOTAL NUMBER OF USED PAPER SHEETS | 823 |
| STATEMENT<br>COPYING FEE PER ONE COPY,<br>COPYING FEE<br>NUMBER OF USED PAPER SHEETS<br>AT THE PRESENT COPYING TIME<br>TOTAL NUMBER OF USED PAPER SHEETS | 825 |
| MEMO | 715 |

Fig. 41.

LEDGER
LEAVES 1000
FEE $ 130
129
Fig.43A.
LETTER
LEAVES 0100
FEE $ 100
129
Fig.43D.
COMPUTER
LEAVES 1000
FEE $ 130
129
Fig.43B.
STATEMENT
LEAVES 0030
FEE $ 30
129
Fig.43E.
LEGAL
LEAVES 5000
FEE $ 300
129
Fig.43C.
SUM
LEAVES 8500
FEE $ 690
129
Fig.43F.
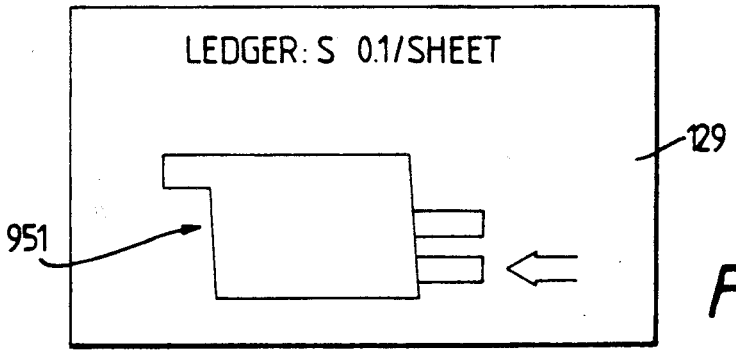
Fig.44A.
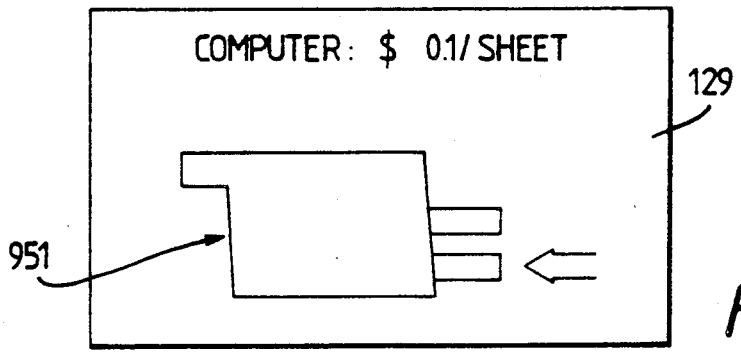
Fig44B.

APPARATUS WITH COPYING FEE BASED ON SIZE AND NUMBER OF SHEETS USED

BACKGROUND OF THE INVENTION

1. Field of the Invention

The present invention relates to an apparatus for feeding sheet material, and more particularly, to an apparatus for feeding sheet material and calculating a fee in accordance with the number of sheets of the sheet material fed.

2. Description of the Related Art

An apparatus for feeding a sheet material, such as a paper sheet, is used in an image forming apparatus so as to feed the sheet material to an image forming section. In actual use, a user pays an owner of the copying machine, such as a photocopy machine or a printer, for the frequency of use of the copy machine. Generally, the frequency of use of the copy machine is counted by a key counter as shown in U.S. Pat. No. 4,586,034. The user then pays the owner in accordance with the frequency of use of the copying machine.

The fee for the copying operation, however, sometimes should depend on the size of the paper sheet. It is not correct to always pay corresponding to the frequency of use of the copying machine.

SUMMARY OF THE INVENTION

It is accordingly an object of the present invention to provide an apparatus for feeding a sheet material which can accurately determine the fee for the number of sheets of material used corresponding to the size of the sheet material.

According to the present invention there is provided an apparatus for feeding sheet material comprising means for detecting the size of the sheet material. A fee is caluculated based on the detected size of the sheet material.

Other objects, features, and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference characters designate the same or similar parts throughout the figures thereof and wherein:

FIG. 10 shows an arrangement of a first memory used in the circuit diagram of the copying machine shown in FIG. 9;

FIGS. 17 and 18 show examples of a liquid crystal display showing the information obtained in the step shown in FIG. 16;

FIGS. 20, 21, and 22 show reports on paper sheets of the information obtained in the step shown in FIG. 19;

FIG. 35 shows the memory configuration used in FIG. 34;

FIG. 41 shows the memory configuration used in the circuit diagram shown in FIG. 40;

FIGS. 43A, 43B, 43C, 43D, 43E, 43F, 44A and 44B illustrate the other information display in the liquid crystal display shown in FIG. 2.

DETAILED DESCRIPTION OF THE PREFERRED EMBODIMENTS

Figure 1:
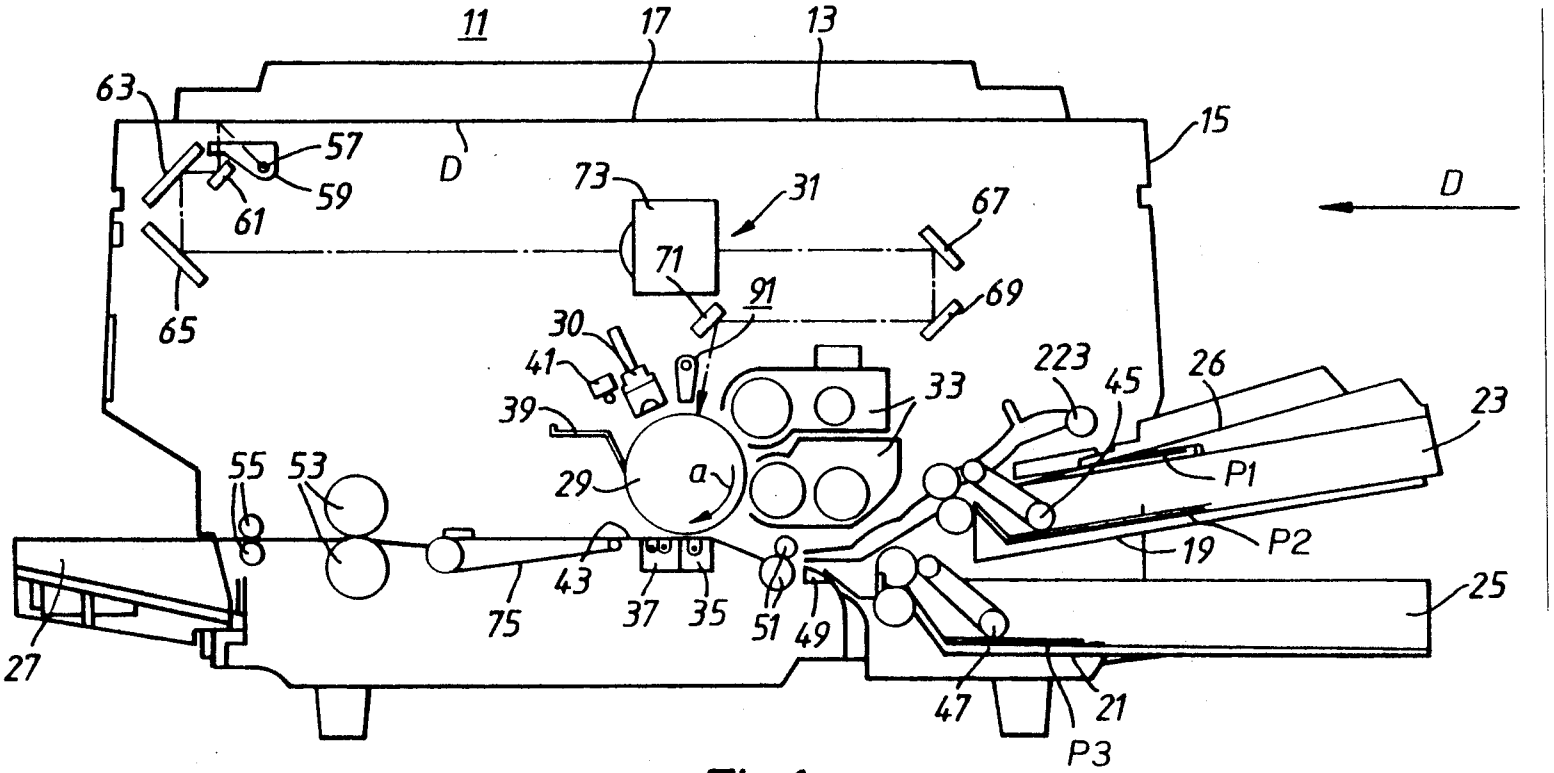
FIG. 1 is a copying machine in which an apparatus for feeding sheet material according to the invention is contained.

Referring now to FIG. 1, a copying machine 11 includes a glass document table 13, provided on the top of a body 15 of copying machine 11 (hereinafter referred to as body 15), for placement of a document D to be copied. Next to the glass document table 13 is provided an operating panel 17 for giving a plurality of information. At the right-hand side of body 15 is provided an upper feeder 19 and a lower feeder 21 for feeding paper sheets one by one from a stack of paper sheets. An upper cassette 23 and a lower cassette 25, which serve to contain the stack of paper sheets, are inserted into upper and lower feeders 19 and 21 respectively. A manual paper feeder 26, which forms the cover of upper cassette 23, feeds a paper sheet P1 manually if need arises. At the left-hand side of body 15 there is provided a tray 27 for receiving the copied paper sheet.

A photosensitive drum 29 is disposed substantially at the center of body 15. Disposed around photosensitive drum 29 are a charger 30 for charging the surface of photosensitive drum 29 at an uniform potential. An optical system 31 exposes the charged surface of photosensitive drum 29 to make a latent image according to the document D. A developing unit 33 develops the latent image on the surface of photosensitive drum 29 with a toner. A transferring unit 35 transfers the developed image onto the paper sheet P. Separating unit 37 separates the paper sheet with the developed image from the surface of photosensitive drum 29. A cleaning unit 39 scraps off residual toner from the surface of photosensitive drum 29. A discharging unit 41 erases the residual charge on the surface of photosensitive drum 29 after the residual toner is scraped off.

The sheet paper P is transported along a feed path 43 from upper cassette 23 or lower cassette 25. A paper sheet P2 is taken out from upper cassette 23 by a first pickup roller 45, a sheet paper P3 is taken out from lower cassette 25 by a second pickup roller 47. The sheet paper P1 is manually fed from manual paper feeder 26. Each paper sheet P1, P2, P3 is tranported to tray 27 through a gap between photosensitive drum 29 and transferring unit 35. A paper stop switch 49, aligning rollers 51, heat rollers 53 and discharging rollers 55 are disposed in this order along feed path 43.

Optical system 31 includes an exposure lamp 57, having its back covered with a reflector 59, for irradiating the document D on table 13. The reflected light is caused to go onto the surface of photosensitive drum 29 through mirrors 61, 63, 65, 67, 69 and 71 and a lens 73.

Photosensitive drum 29 is driven in the direction of an arrow a by a driving mechanism (not shown) synchronously with optical system 31. At the time of copying, photosensitive drum 29 is uniformly charged by charger 30. Subsequently, document D is uniformly illuminated by exposure lamp 57, so that the image on document D is projected onto photosensitive drum 29 by optical system 31. In response to the document image, a latent image is formed on surface of photosensitive drum 29. The latent image is developed by developing unit 33.

Prior to copying, the paper sheets P1, P2 or P3, which are fed automatically or manually, are transported to aligning rollers 51 through paper stop switch 49. Paper P is stopped by aligning rollers 51. Paper stop switch 49 detects when paper sheet P reaches aligning rollers 51. After the detection of paper P, aligning rollers 51 are caused to rotate synchronously with the rotation of photosensitive drum 29. Paper P is fed between photosensitive drum 29 and separating unit 35. A toner image is transferred onto paper P by transferring unit 35. Then paper sheet P with the toner image is separated from photosensitive drum 29 by separating unit 37. After separation, paper P is guided to heat rollers 53 by a belt 75. The transferred image is fixed by heat rollers 53. Paper sheet P with the fixed image is then discharged to tray 27 by discharging rollers.

After the toner image is transferred onto paper sheet P, the residual toner on photosensitive drum 29 is scraped off by cleaning unit 39. Afterward the residual charge on photosensitive drum 29 is erased by discharging unit 41 to make ready for the next copying operation.

Furthermore, copying machine 11 includes a writing unit 91 for writing information about a copying fee. The details of writing unit 91 will be described herafter.

Figure 2:
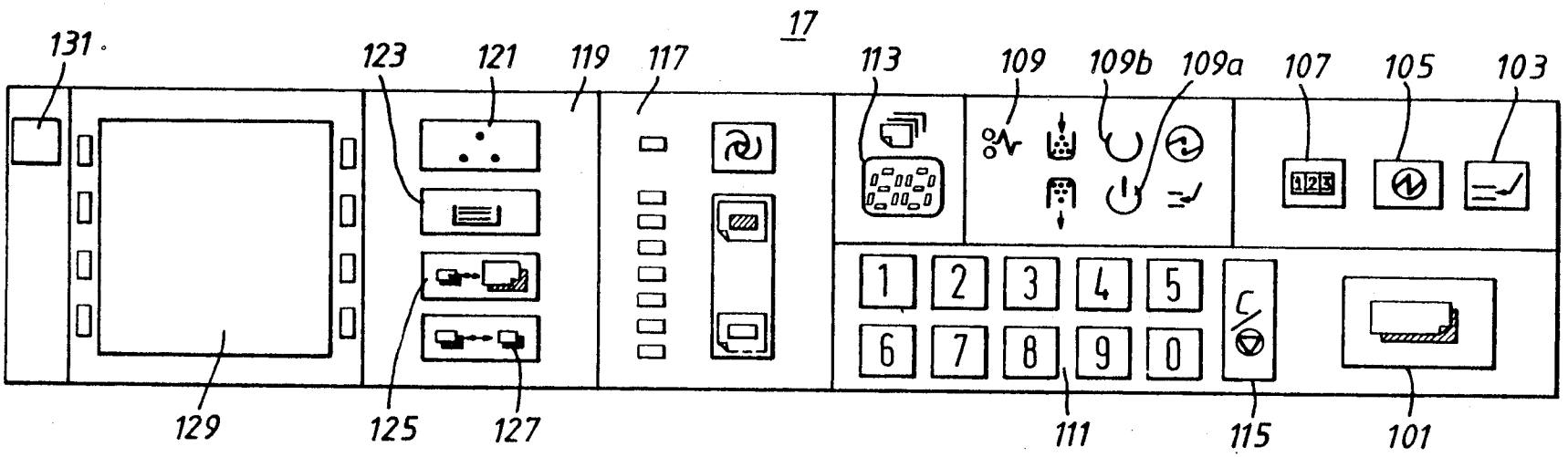
FIG. 2 is a top plan view of an operating panel which forms a part of the copying machine shown in FIG. 1.

Referring now to FIG. 2, operating panel 17 includes a print key 101 for causing the copying machine to start the copying operation, provided in the lower right-hand section thereof. Above print key 101 is provided an interrupt key 103 for setting an interrupt mode for interruping the copy operation. Adjacent to interrupt key 103 is provided an energy save key 105 for causing copying machine 11 to go into an energy saving mode. Adjacent to energy saving key 105 is provided a counter key 107 for displaying the quantity of copies made since the inotallation of copying machine 11 or its repair.

The condition of copying machine 11 is indicated by a condition panel 109. Condition panel 109 has a plurality of light-emitting diodes (hereafter referred to as LEDS) (not shown). The LEDs are covered with a plane having a plurality of symbols indicating the condition of copying machine 11, e.g., a warm-up mode symbol 109*a* for indicating that copying machine 11 is in a warm-up mode, a ready symbol 109*b* for indicating that copying machine 11 is in a ready mode. Digital keys 111 are used to key in a digital number, e.g., a desired number of copies. The quantity of copies set by digital keys 111 is displayed by a copy quantity indicator 113. The quantity of copies set by digital keys 111 may be corrected by the operation of a clear/stop key 115. Furthermore, the operation of clear/stop key 115 causes copying machine 11 to stop a multicopy run. The condition of exposure is selected by the operation of a plurality of switches in an exposure setting area 117. Adjacent to exposure setting area 117 is provided a condition setting area 119 including a plurality of keys. One of keys is a color select key 121 for selecting a toner, e.g., black toner or red toner. A cassette select key 123 is used for selecting one of cassettes 23 and 25. An enlargement/reduction mode is selected by the operation of a zoom key 125. If a unity magnification mode is needed, 100% key 127 is operated so that copying machine 11 makes actual size copies.

A liquid crystal display (hereafter referred to as LCD) 129 shows the operating conditione of copying machine 11 except those displayed by condition panel 109, e.g., a reproduction ratio set by zoom key 125 or the quantity of copies in accordance with the size of the paper sheet P on which copies are made.

The quantity of copies in accordance with the size of the paper sheets P which are used in copying operation is written down on a paper sheet P automatically fed from upper cassette 23 in response to the operation of an information key 131. The detail of the operation of information key 131 will be explained referring FIG. 16.

Figure 3:
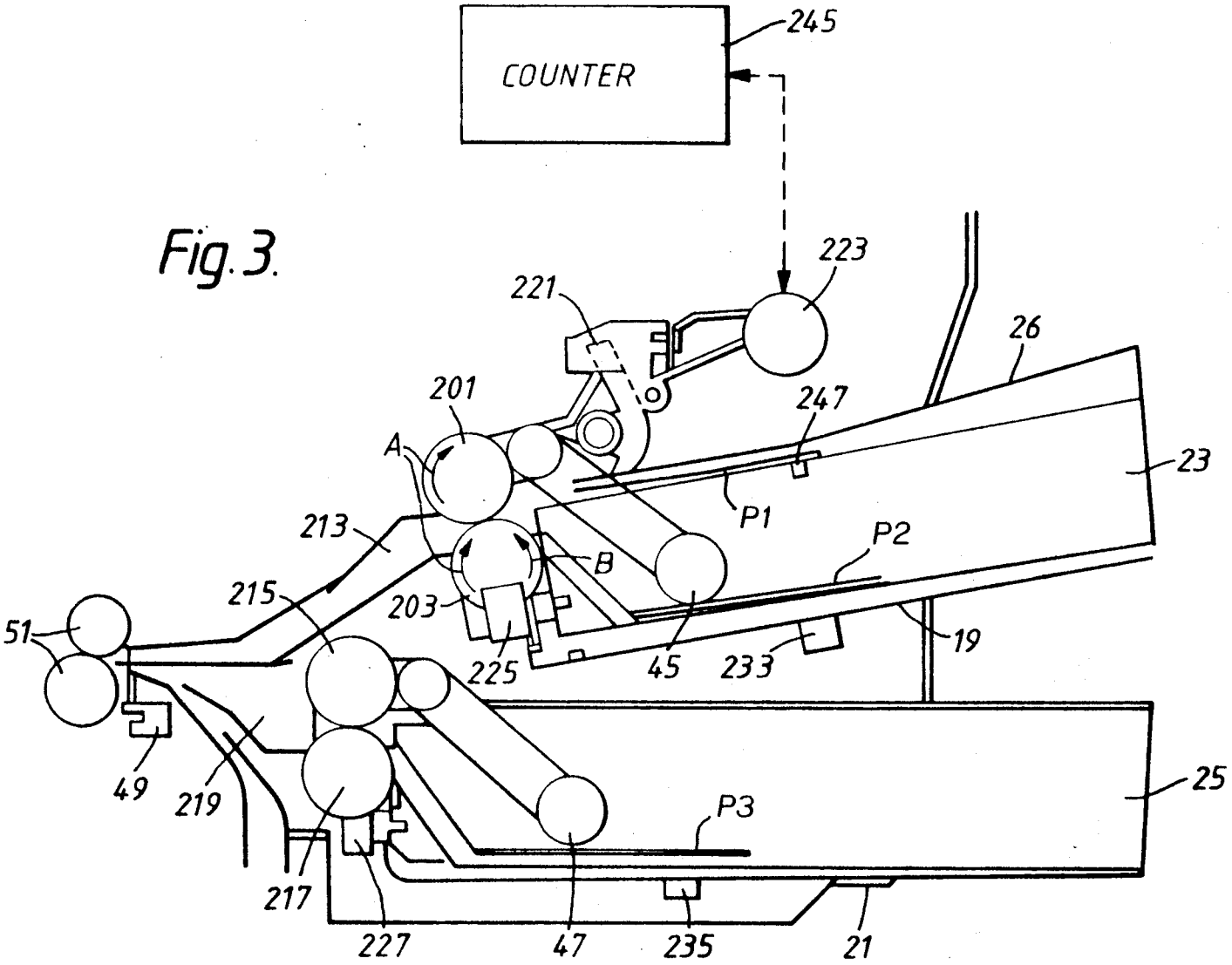
FIG. 3 is a schematic sectional view of a feeding mechanism which forms a part of the copying machine shown in FIG. 1.

Referring now to FIG. 3, the mechanism of upper, lower and manual paper feeders 19, 21 and 26 will be described in detail.

Upper and lower cassettes 23 and 25 are removably mounted in upper and lower feeders 19 and 21. In response to the insertion of upper cassette 23, first pickup roller 45 is moved down onto paper sheet P2 in upper cassette 23 by a driver (not shown). When upper cassette 23 is selected, in response to the operation of print key 101, first pickup roller 45 is rotated so that the top sheet of paper sheets P2 in upper cassette 23 is picked up from upper cassette 23.

A feeding roller 201 and a separating roller 203, deposited near an outlet of upper cassette 23, start to rotate in the direction of arrow A shown in FIG. 3 synchronously with the rotation of first pickup roller 45.

Figure 4:
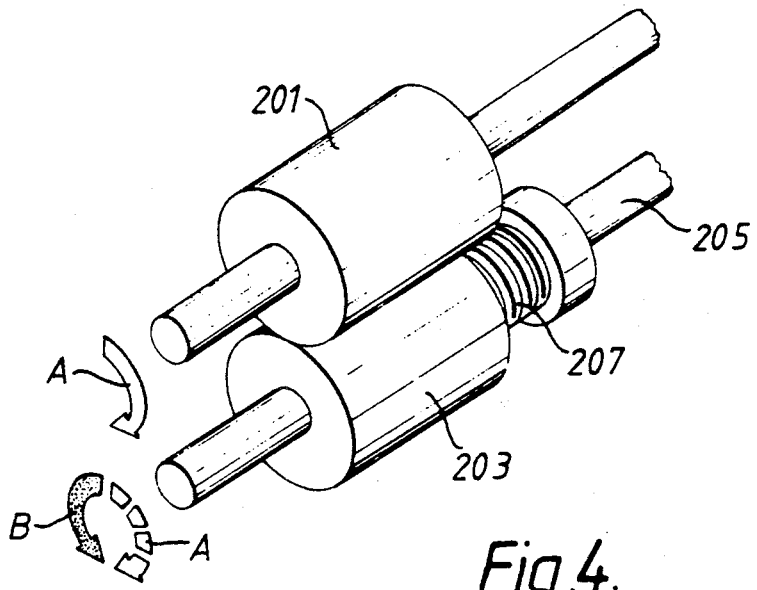
FIG. 4 is a perspective view of a feeding roller and separating roller which are used in the feeding mechanism shown in FIG. 3.

Referring now to FIG. 4, separating roller 203 is connected to a shaft 205 through a spring joint 207. When there is no paper sheet or only one paper sheet between feeding and separating rollers 201 and 203, the friction between feeding and separating rollers 201 and 203 or that between the paper sheet and separating roller 203 is large enough to cause separating roller 203 to rotate in the direction of an arrow B shown in FIG. 4 and spring joint 207 to slip.

Figure 5:
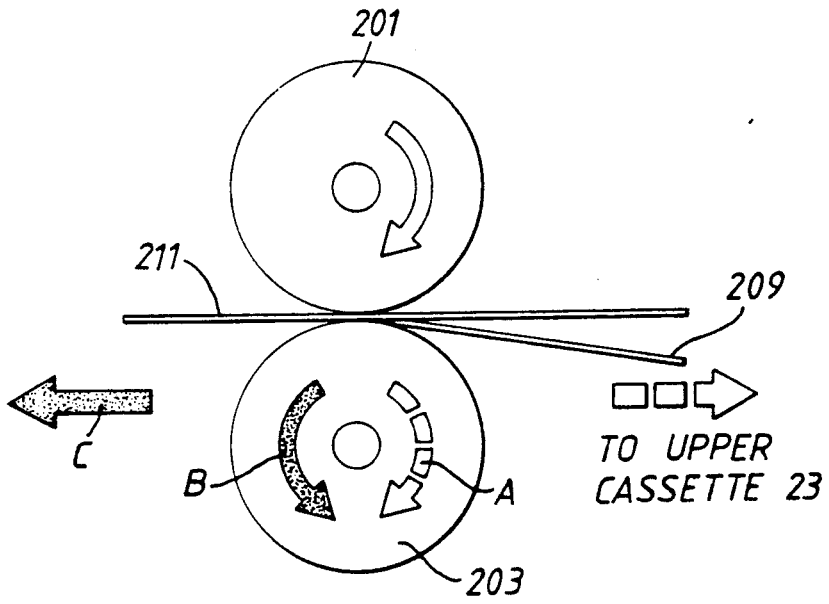
FIG. 5 is a schematic sectional view of the feeding roller and the separating roller shown in FIG. 4.

Referring now to FIG. 5, if pickup roller 45 picks up not one paper sheet but a plurality of paper sheets so that a plurality of paper sheets are fed between feeding and separating rollers 201 and 203, a double-sheet feeding occurs. The friction between paper sheets P2 is smaller than that between separating roller 203 and paper sheet P2. Separating roller 203 is rotated in the direction of the arrow A. A lower paper sheet 209 is caused to separate from an upper paper sheet 211 and is sent back to upper cassette 23 by separating roller 203. Upper paper sheet 211, however, is fed in the direction of an arrow C by feeding roller 201.

Referring now to FIG. 3 again, paper sheet P2 is fed toward aligned rollers 51 through a first feeding path 213. The leading edge of paper sheet P2 is aligned by aligning rollers 51 which stop rotating. At the same time, paper sheet P2 turns on paper stop switch 49 and then aligning rollers 51 are caused to rotate in order to feed paper sheet P2.

Lower feeder 21 includes second pick up roller 47, feeding and separating rollers 215 and 217, and a second feeding path 219. Lower feeder 21 operates the same as upper feeder 19, described above.

When paper sheet P1 is manually loaded into manual paper feeder 26, manual feed switch 221 is turned from off to on, thereby detecting the manual set of paper sheet P1. In response to the detection of the paper sheet P1, manual feeding roller 223 is lowered and then rotated by a driving mechanism (not shown) to feed the paper sheet P1 to a position between feeding roller 201 and separating roller 203 of upper feeder 19. The paper sheet P1 is fed toward aligning rollers 51 through first feeding path 213 in the same way as the paper sheet P2 described above.

The size of each paper sheet fed by the above mechanism is detected as follows;

Upper and lower feeders 19 and 21 include an upper size switch 225 and a lower size switch 227. The structure of only upper size switch 225 will be described, as the structure of upper size switch 225 is the same as that of lower size switch 227.

Figure 6:
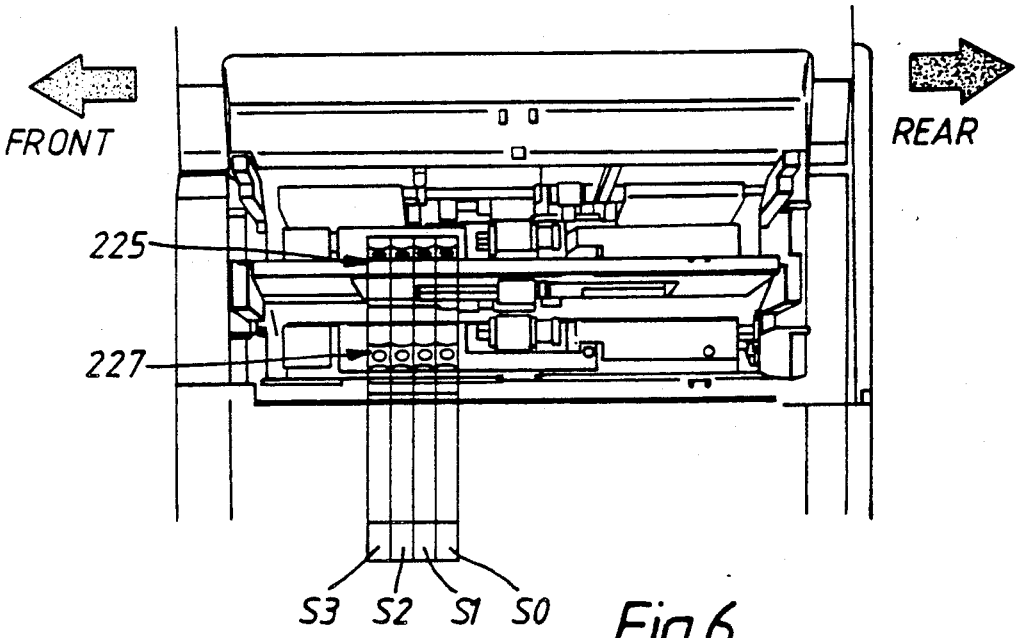
FIG. 6 is a side view of the copying apparatus for showing a size detector which is used in the feeding mechanism shown in FIG. 3.

FIG. 6 shows a view in the direction of the arrow D in FIG. 1 of the copying apparatus with upper and lower cassette 23 and 25 removed from body 15. As shown in FIG. 6, upper size switch 225 includes four detectors S0, S1, S2 and S3 for outputting signals in response to pressure thereon. The four detectors S0, S1, S2 and S3 are located in a line and at the interior of the cassette receiving portion of upper size switch 225.

Figure 7:
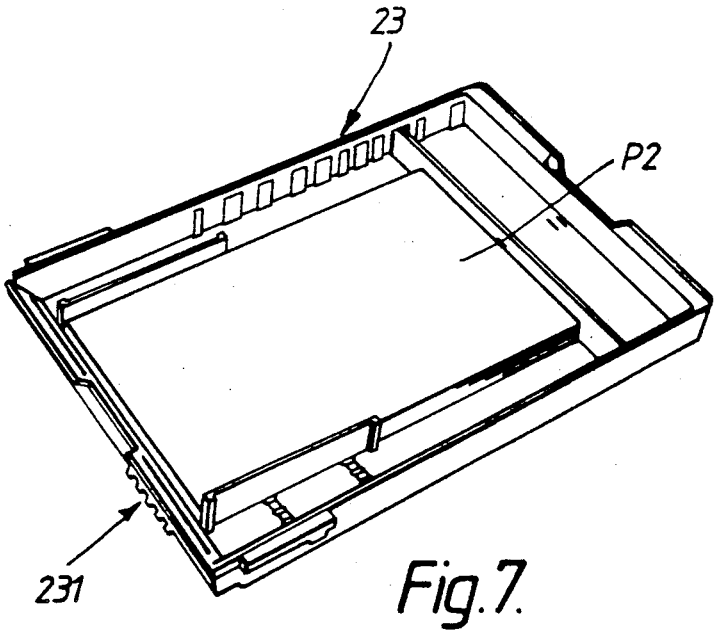
FIG. 7 is a perspective view of a cassette which stores a plurality of paper sheets fed by the feeding mechanism shown in FIG. 3.

Referring now to FIG. 7, upper cassette 23 includes a plurality of size-indicating projections 231 for indicating the size of the paper sheet stored in the cassette. In the present embodiment, each cassette stores paper sheets with a predetermined size. In accordance with the predetermined size of the paper sheets, the number and position of size-indication projections 231 was decided. The relation between th size of paper sheets stored in upper or lower cassette 23 or 25 and the output signal from four detectors S0, S1, S2 and S3 is as shown in TABLE 1.

TABLE 1

| Cassette-paper size | Detection switch S3 | S2 | S1 | S0 |
|---|---|---|---|---|
| LEDGER | — | — | 0 | — |
| LEGAL | — | 0 | — | — |
| COMPUTER | — | 0 | — | — |
| LETTER-R | 0 | — | — | 0 |
| LETTER | 0 | 0 | — | — |
| STATEMENT-R | 0 | 0 | — | 0 |

In TABLE 1, a mark "0" indicates that size-indicating projection 231 pushes one of four detectors S0, S1, S2 and S3. A mark "—" indicates that size-indicating projection 231 does not push one of four detectors S0, S1, S2, and S3. The output signals from four detectors S0, S1, S2 and S3 are sent to a CPU 232 (see FIG. 9) which processes the output signals to detect the size of paper sheets stored in upper or lower cassette 23 or 25 in accordance with the combinations of the output signals from four detectors S0, S1, S2 and S3. All output signals with mark "—" means that a cassette is not inserted into body 15. In response to the output signals from four detectors S0, S1, S2 and S3, CPU 232 causes information corresponding to the output signals from four detectors S0, S1, S2 and S3 to be displayed in LCD 129. Referring now to FIG. 3 again, paper empty switches 233 and 235 detect whether or not there is any paper sheet in upper and lower cassettes 23 and 25 respectively. In response to output signals from paper empty switches 233 and 235, CPU 232 causes LCD 129 to display information corresponding to the output signals from paper empty switches 233 and 235.

Figure 8:
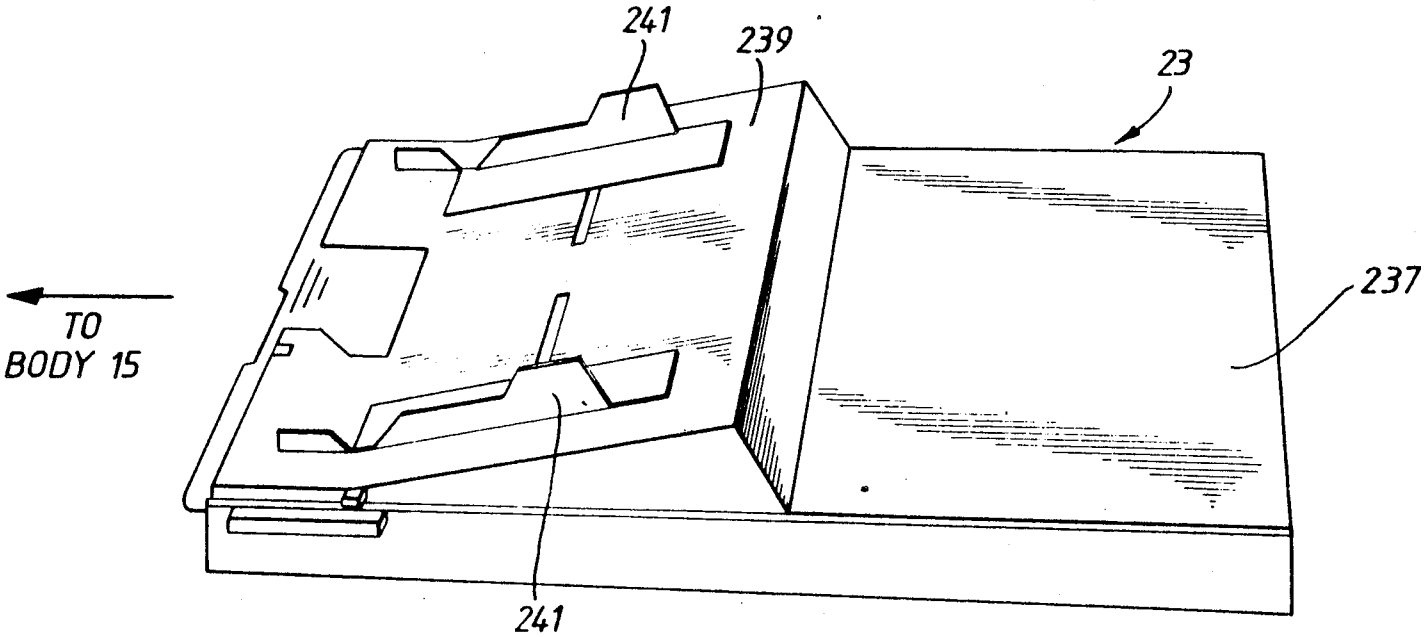
FIG. 8 is a perspective view of a cassette with a manually feeding unit which receives the paper sheet fed by the feeding mechanism shown in FIG. 3.

Referring now to FIG. 8, upper cassette 23 includes a cover 237. A manual paper guide 239, which forms a front portion of cover 237, includes a slidable guide 241 which is slidable connected to the upper surface of manual paper guide 239. The position of slidable guide 241 is adjusted in accordance with the width of the manually fed paper sheet P1. The width of the paper sheet P1 may be detected by the position of slidable guide 241. This detection based on the position of slidable guide 241, however, is sometimes in error. the present invention, the size of paper sheet P1 is detected by two devices 245 and 247(FIG. 3). A counter 245 detects the number of revolutions of manual feed roller 223 in order to detect the length of paper sheet P1. A manual size switch 247 detects whether the width of paper sheet P1 is glaten than that of a letter size paper sheet. This is because a lateral feeding of letter size paper would not be distinguished from a longitudinal feeding of statement size paper using only the number of revolutions corresponding to the length of the paper sheet.

The size of paper sheet used in the present copying machine 1 is as shown in TABLE 2.

TABLE 2

| NAME | MEASURE (mm) |
|---|---|
| STATEMENT | 137.7 × 215.9 |
| LETTER | 215.9 × 279.4 |
| LEGAL | 215.9 × 355.6 |
| COMPUTER | 257.2 × 355.6 |
| LEDGER | 279.4 × 431.8 |

The operation of manual size switch 247 is as shown in TABLE 3.

TABLE 3

| SIZE | MANUAL SIZE SWITCH 247 | WIDTH OF PAPER SHEET |
|---|---|---|
| STATEMENT-R | OFF | 139.7 |
| LETTER | ON | 279.4 |
| LETTER-R | OFF | 215.9 |
| LEGAL | ON | 355.6 |
| COMPUTER | ON | 355.6 |
| LEDGER | ON | 431.8 |

Figure 9:
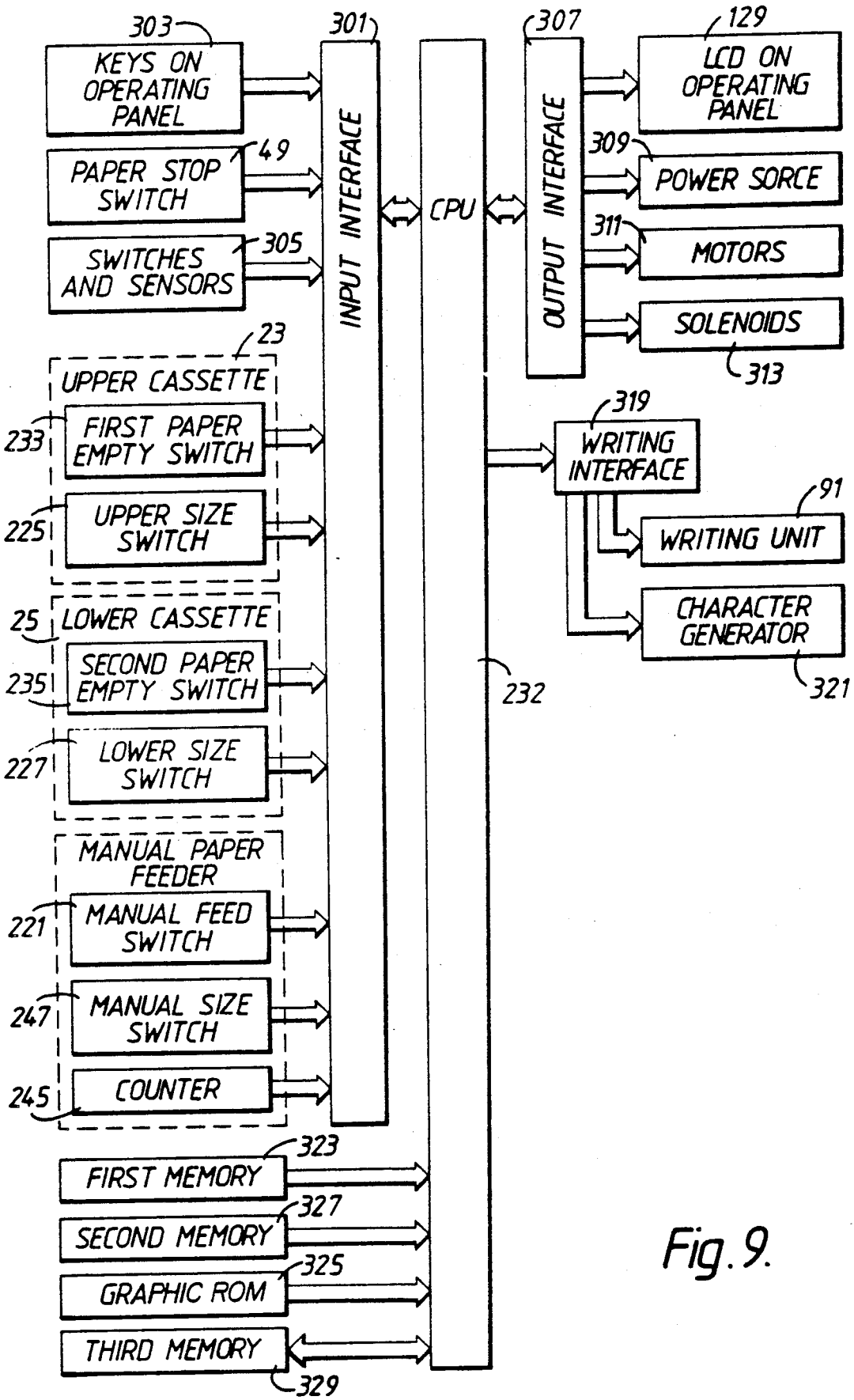
FIG. 9 is a circuit diagram of the copying machine shown in FIG. 1.

Referring now to FIG. 9, a control circuit for copying machine 11 includes CPU 232 for controlling the operation of copying machine 11. Connected to CPU 232 through an input interface 301 are following devices: keys 303 on operating panel 17, e.g., print key 101 as shown in FIG. 2, paper stop switch 49, switches and sensors 305 used in a plurality of operations of copying machine 11 except a paper feeding operation, first and second paper empty switches 233 and 235, upper and lower size switches 225 and 227, manual feed switch 221, counter 245 and manual size switch 247.

Connected to CPU 232 through an output interface 307 are the following devices: LCD 129 on operating panel 17, power source 309 for supplying power to a plurality of devices in copying machine 11, motors 311 and solenoids for driving mechanical elements according to the CPU.

Connected to CPU 232 through a writing interface 319 are writing unit 91 for writing down the number of used paper sheets in copying machine 11 and a character generator for generating a plurality of characters used by writing unit 321.

CPU 232 is connected to a first memory 323 for storing data about the number of paper sheets counted in accordance with the size of the paper sheets and a graphic ROM 325 for storing data representing a plurality of symbols displayed in LCD 129. CPU 232 is also connected to a second memory 327 for storing a program for CPU 232 and a third memory 329 for storing a personal identification number (hereafter referred to as PIN) and corresponding user's name. The user to whom the PIN is assigned is permitted to use copying machine 11.

Output signals from keys 303, paper stop switch 49 and switches and sensors 305 are supplied to CPU 232 through input interface 301. From these input signals, CPU 232 controls the operation of copying machine 11, except the paper feeding operation.

Output signals from first and second paper empty switches 233 and 235 are supplied to CPU 232 to detect whether there are any paper sheets in upper and lower cassettes 23 and 25 respectively. Output signals from upper and lower size switches 225 and 227 are supplied to CPU 232 to detect the presence of upper and lower cassettes 23 and 25, respectively, and the size of paper sheets in cassettes 23 and 25, respectively.

The output signal from paper stop switch 49 is counted by CPU 232 according to the program stored in second memory 327. The count is the total number of copies made by copying machine 11. The number of used sheets in accordance with the size of the sheets is counted by CPU 232 based on the output signals from upper and lower size switches 225 and 227, manual size switch 247 and counter 245.

The method of counting the number of used sheets in accordance with their size will be described hereafter.

According to the present embodiment, the number of used sheets is counted with respect to not only the size of paper but also the user who uses copying machine 11. The PIN is used for identifying the user. First memory 323 comprises a plurality of storing areas corresponding to PINs and the size of the used paper sheet as shown in FIG. 10. For example, a first storing area 401 is assigned to Mr. A who is one of users and has a PIN A. First storing area 401 comprises a PIN area **401*a* for storing PIN A of Mr. A and a plurality of size areas, e.g., a ledger area 401*b* for storing the number of ledger size paper sheets used, a computer area 401*c* for storing the number of computer size paper sheets used, a legal area 401*d* for storing the number of legal size paper sheets used, a letter area 401*e* for storing the number of letter size paper sheets used, a statement area 401*f* for storing the number of statement size paper sheets used, another area 401*g* for storing the number of paper sheets with the other size used and a sum area 401*h*** for storing the sum of paper sheets used by Mr. A.

Furthermore, first memory 323 includes a fee area 402 for storing data about the copying fee. Fee area 402 comprises an operator code area **402*a* for storing an operator code distinguishing the operator from others, a first fee area 402*b* for storing fee data for the ledger size, a second fee area 402*c* for storing fee data for the computer size, a third fee area 402*d* for storing fee data for the legal size, a fourth fee area 402*e*** for storing fee data for the letter size, a fifth fee area for storing fee data for the statement size, a sixth fee area for storing fee data for the other size.

In the present embodiment, first and third memories 323 and 327 are made of electrically erasable programmable read-only memories (hereafter referred to as EEPROMS). Second memory 327 is made of read only memory (hereafter referred to as ROM).

Figure 11:
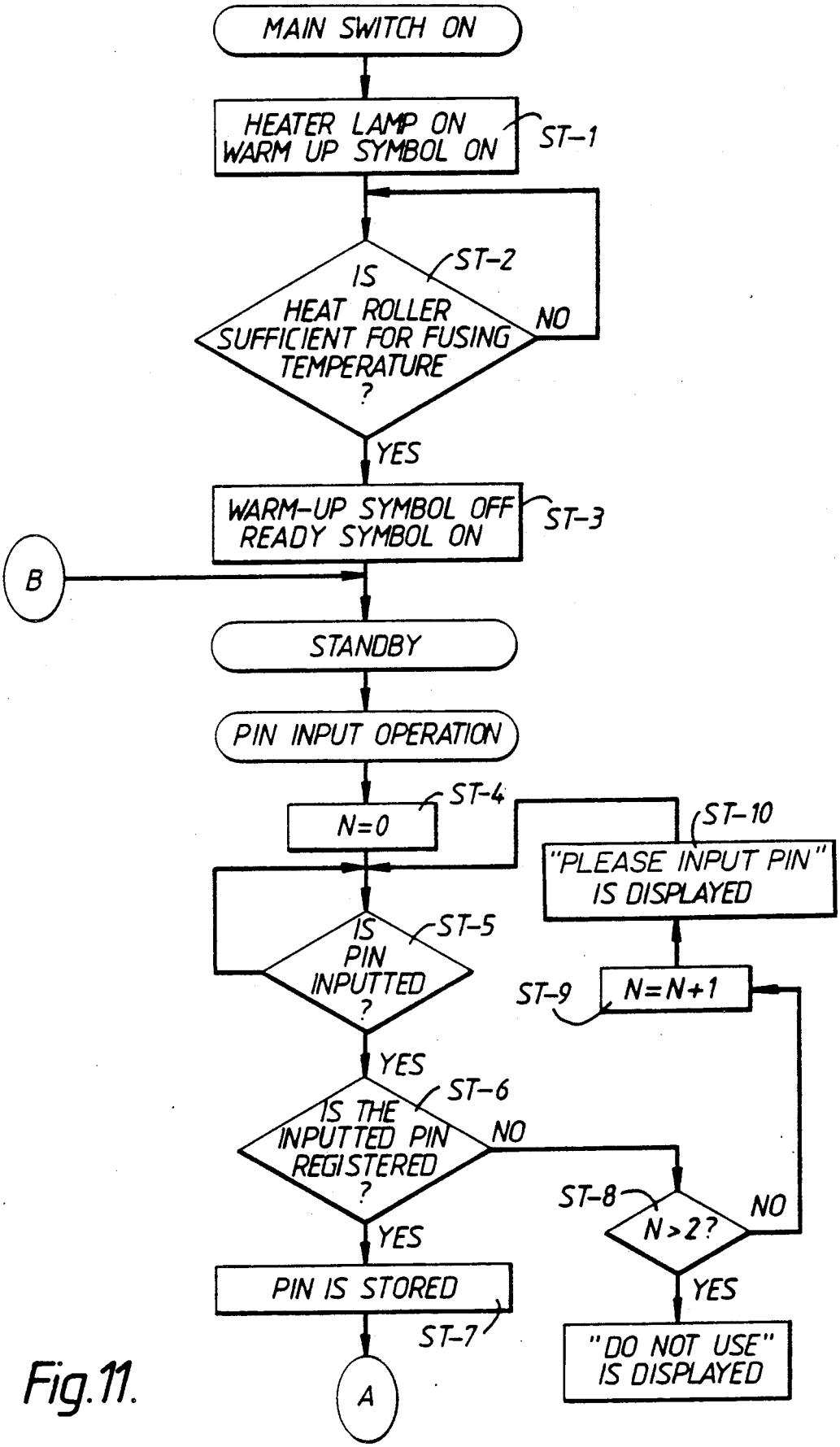
FIGS. 11, 12A and 12B and 13 are flow charts illustrating the operation of the copying apparatus shown in FIG. 1.

Referring now to FIG. 11, the copying operation starts with the operation of a main switch which is one of switches and sensors 305 as shown in FIG. 9. In response to the operation of the main switch, a heater in heat roller 53 and warm-up symbol **109*a*** are turned on (ST-1).

CPU 232 detects whether or not heat roller 53 is at the fusing temperature (ST-2). If heat roller 53 is at the fusing temperature, CPU 232 causes warm-up symbol 109*a* to turn off and ready symbol 109*b* to turn on (ST-3)> the copying machine 11 is then in a standby condition, and permits the input by the operator by keys on panel 17 of operating information.

The operator operates digital keys 111 on panel 17 to input the operator's PIN. CPU 232 checks whether or not the inputted PIN is correct as follows:

CPU 232 initializes a pointer N, that is, the pointer N is set zero (ST-4). CPU 232 detects whether or not PIN is input (ST-5). If PIN is inputted, CPU 232 detects whether or not the input PIN is registered (ST-6). The authorized PIN is stored in third memory 329 corresponding to the name of the user who has the authorized PIN. If the inputted PIN is registered in third memory 329, the inputted PIN is stored in a working memory (ST-7) and then CPU 232 goes to step A. Alternately, CPU 232 may check whether or not the inputted PIN is registered in each PIN area 401*a* in first memory 323. In this case, third memory 329 may be unnecessary.

In the step ST-5, if a PIN is not input, CPU checks again whether or not a PIN is input. By this loop, CPU 232 waits for the input of a PIN. In the step 6, if the inputted PIN is not registered, CPU 232 checks whether or not the pointer N exceeds two (ST-8). If the pointer N exceeds two, CPU 232 causes LCD 129 to display a message "DO NOT USE". This is because CPU 232 concludes that the user inputting a PIN is an unautherized person if a non registered PIN is input more than three times.

In the step ST-8, if the pointer N does not exceed two, CPU 232 adds N and one (ST-9). CPU 232 causes LCD 129 to display a message "Please input PIN" in order to ask the user to input a PIN again (ST-10) and then goes back to the step ST-5.

Figure 12A:
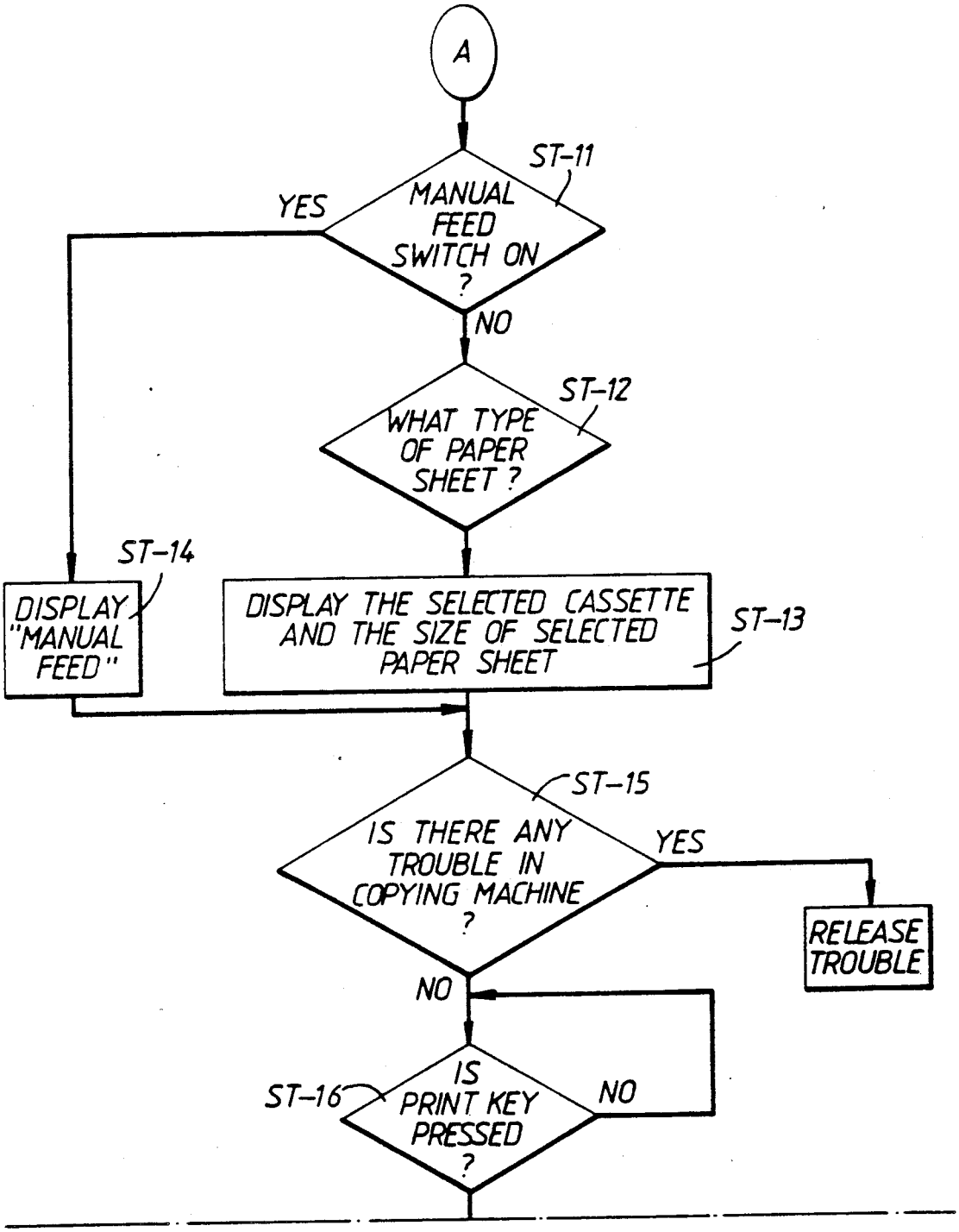
Figure 12B:
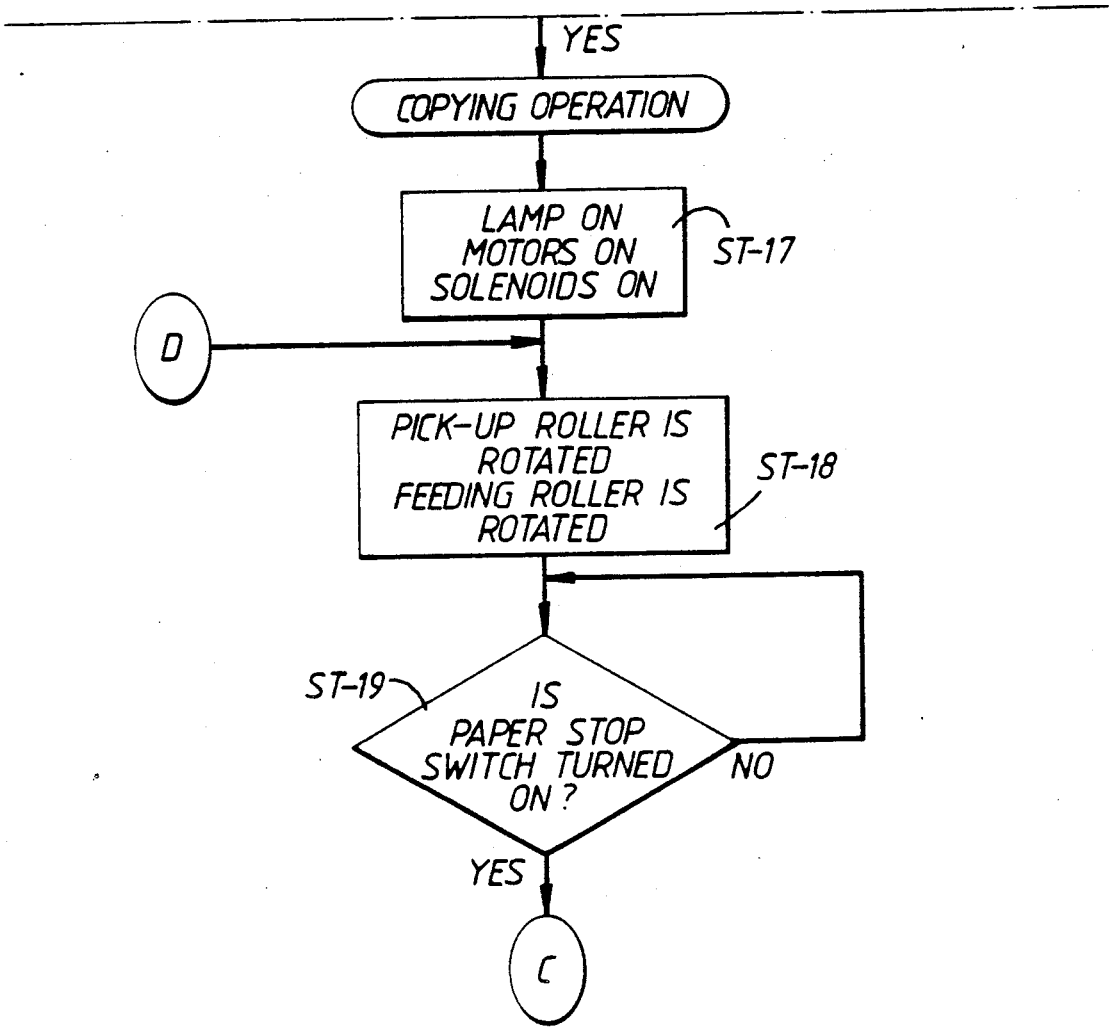

Referring now to FIG. 12, after the step ST-7, CPU 232 checks whether manual feed switch 221 is turned on (ST-11). If manual feed switch 221 is not turned on by the paper sheets P1, CPU 232 detects what type of paper sheet is selected (ST-12). This step will be detailed later.

After step ST-12, CPU 232 causes LCD 129 to display the selected cassette 23 or 25 and the size of the paper sheet in the selected cassette 23 or 25 (ST-13).

In the step ST-11, if the manual feed switch 221 is turned on, CPU 232 causes copying machine 11 to be in a manually feeding mode and LCD 129 to display a message "MANUAL FEED" (ST-14). In the manual feed mode, a copy is made on the manually fed paper sheet P1 irrespective of cassette 23 of 25.

After the steps ST-13 and ST-14, CPU 232 checks whether or not there is any trouble in copying machine 11, CPU 232 checks whether or not print key 101 is pressed (ST-16). If print key 101 is not pressed, CPU 232 checks again whether or not print key 101 is pressed, so that CPU 232 waits for the input of print key 101.

If print key 101 is pressed, CPU 232 goes to the copying operation. That is, CPU 232 causes lamp 59, (See FIG. 1), motors 311 and solenoids 313 to turn on. (ST-17). CPU 232 causes one of pick up rollers 45, 47 and 223 and one of feeding rollers 201 and 215 to rotate in accordance with the paper selection (ST-18). Then, CPU 232 checks whether or not paper-stop switch 49 is turned on and continues to check until CPU 232 detects paper-stop switch 49 has been turned on by the paper sheet (ST-19).

Figure 13:
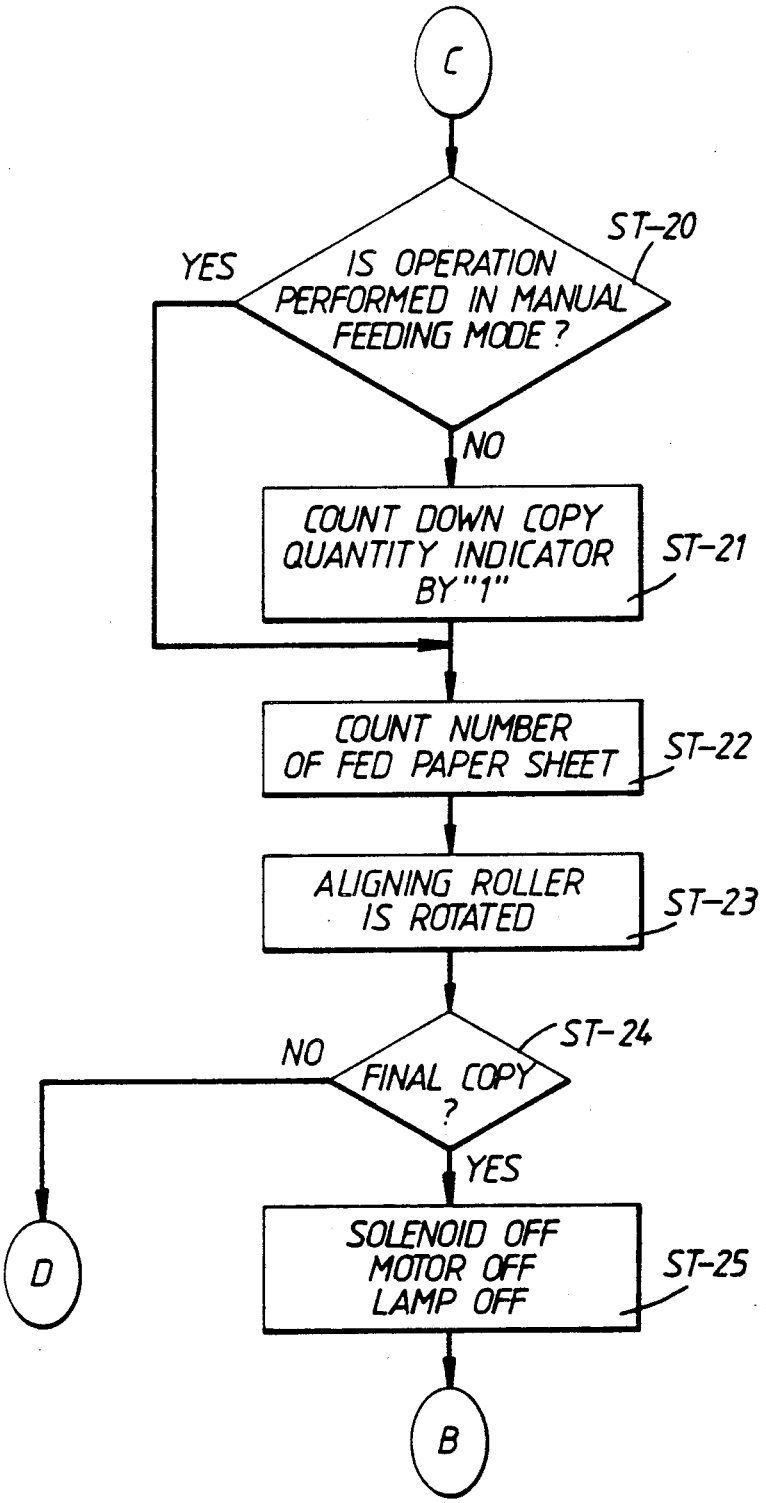

Referring now to FIG. 13, CPU 232 checks whether or not copying operation is to be performed in the manual feeding mode (ST-20). If a copying operation is not to be performed in the manual feeding mode, CPU 232 causes the copy quantity shown in copy quantity indicator 113 to be counted down by one and displays the counted quantity in copy quantity indicator 113 (ST-21). CPU 232 counts the number of paper sheets fed corresponding to thin size (ST-22). The step for counting the number paper sheets fed corresponding to their size will be detailed later.

After counting, CPU 232 causes aligning rollers 51 to rotate so that the paper sheet is moved synchronously with the rotation of photosensitive drum 29 (See FIG. 1) (ST-23). CPU 232 checks whether or not the present paper sheet is for a final copy (ST-24). If the present paper sheet is for the final copy, CPU 232 causes lamp 57, motors 311 and solenoids 313 to turn off (ST-25) and then goes back to the step ST-4 shown in FIG. 11.

In the step 20, if the copying operation is performed in the manual feeding mode, CPU 232 jumps to the step ST-22. This is because the manual feeding mode is treated as an interrupt mode.

In the step ST-24, if the present copy is not the final copy, CPU 232 goes back to the step ST-18.

Figure 14A:
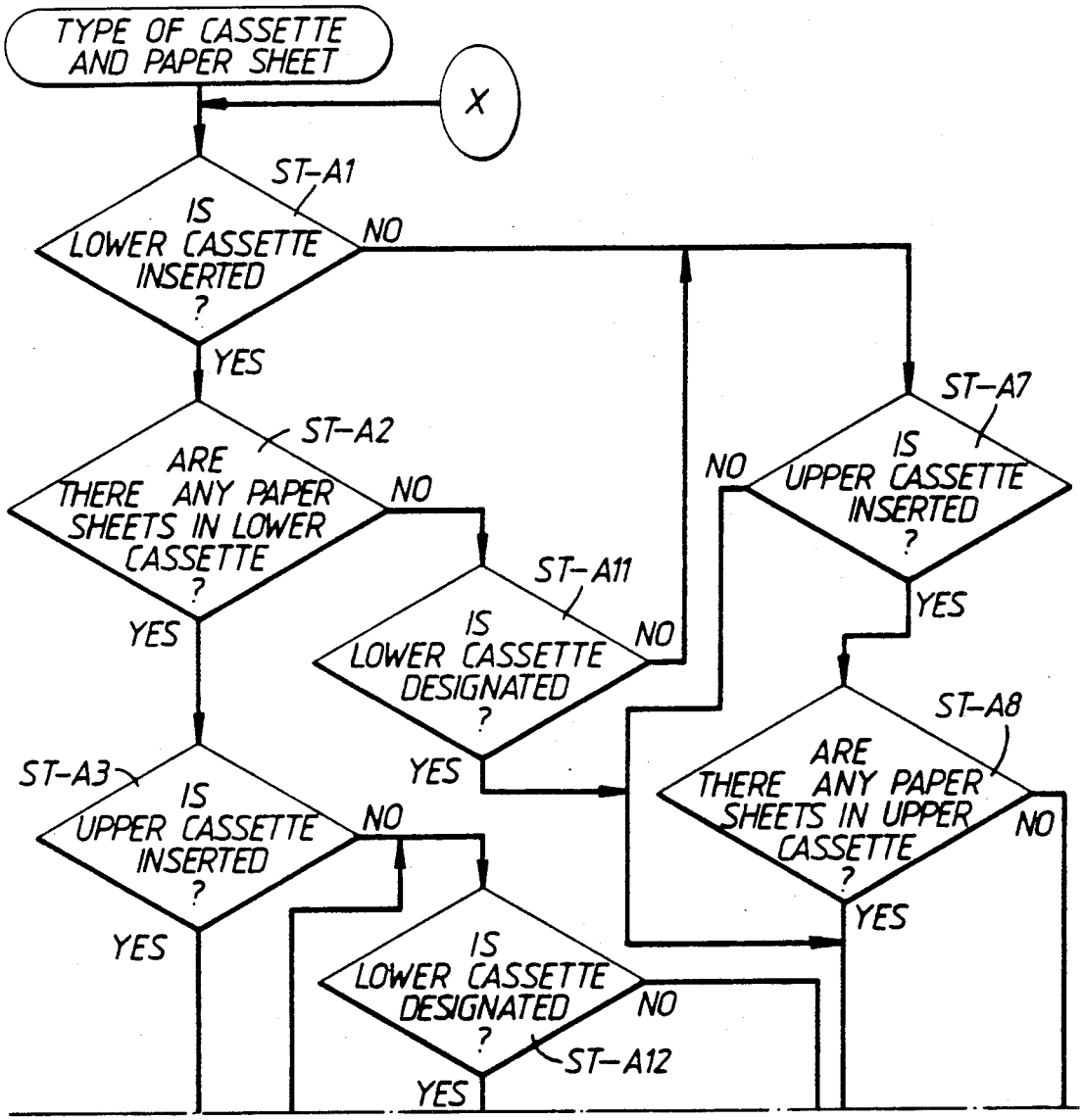
FIGS. 14A and 14B is a flow chart illustrating the steps which form a portion of the operation shown in FIGS. 12A and 12B, for detecting the presence of the cassette shown in FIGS. 1,3,7 and 8 and the size of the paper sheet stored in the cassette.
Figure 14B:
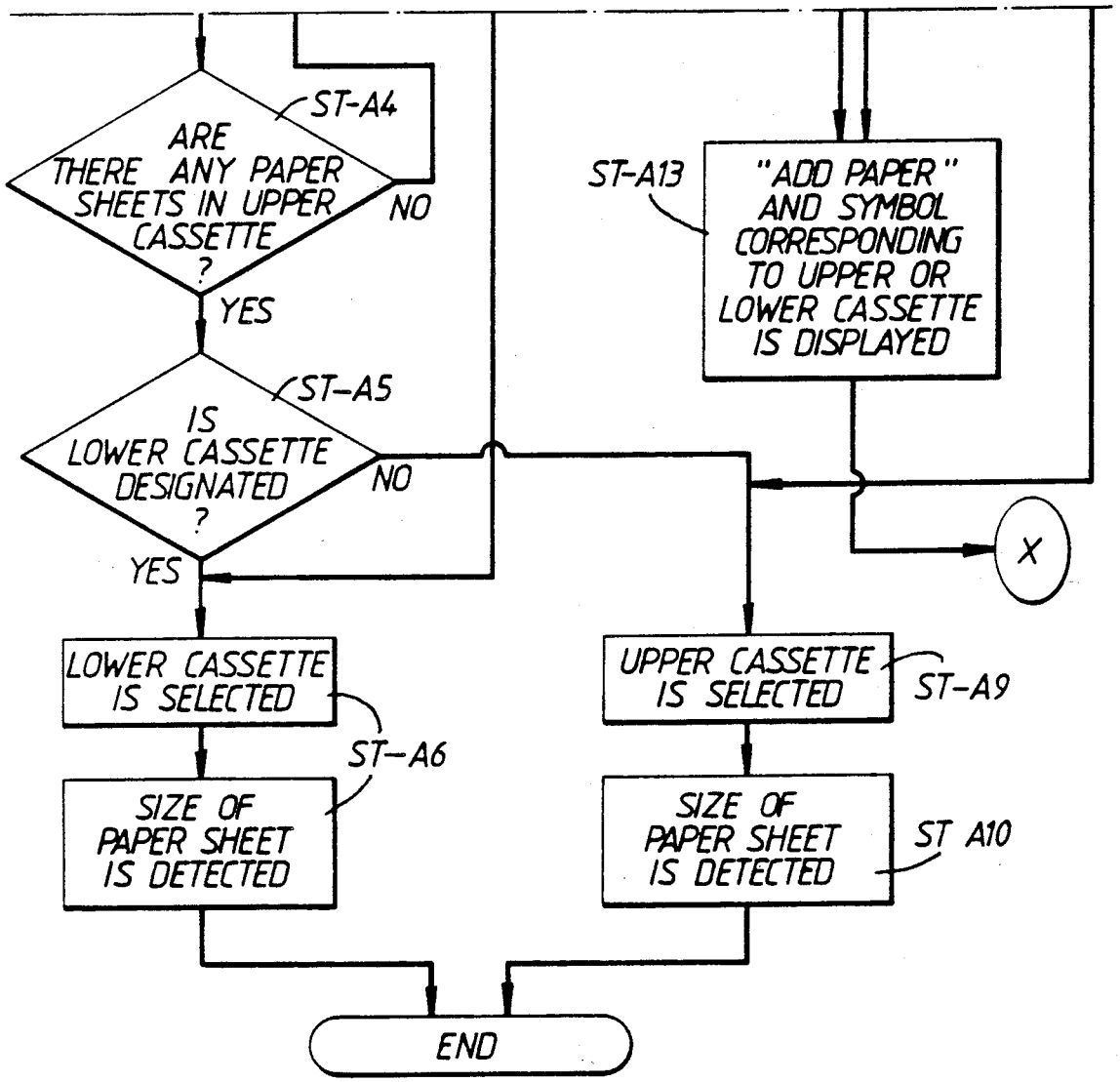

Referring now to FIG. 14, the steps for detecting the size of the paper sheet used will be detailed.

CPU 232 checks whether or not lower cassette 25 is inserted into body 15 (ST-A1). CPU 232 receives the output signal from four detectors S0, S1, S2 and S3 of lower size switch 227 and concludes that there is no lower cassette 25 if all four detectors S0, S1, S2 and S3 send the signal "—"(See TABLE 1). If at least one signal is "○", CPU determines that cassette 25 is inserted into body 15.

If lower cassette 25 is inserted into body 15, CPU 232 checks whether there is a paper sheet in lower cassette (ST-A2). This detection comes from the output signal of second paper empty switch 235.

If there are paper sheets in lower cassette 25, CPU 232 checks whether upper cassette 23 is inserted into body 15 (ST-A3). If upper cassette 23 is inserted into body 15, CPU 232 checks whether there is paper sheets in upper cassette 23 (ST-A4). If there are some paper sheets in upper cassette 23, CPU 232 checks whether lower cassette 25 is designated through the operation of cassette select key 123 (ST-A5). If lower cassette 25 is designated, CPU 232 causes the paper sheet P in lower cassette 25 to be used in the copying operation. CPU 23 then detects the size of the paper sheets in lower cassette 25 from the output signal of detectors S0, S1, S2 and S3 of lower size switch 227 (ST-A6). Data about the detected size is stored in the working memory.

In the step ST-A1, if lower cassette 25 is not inserted into body 15, CPU 232 checks whether upper cassette 23 is inserted into body 15 (ST-A7). If upper cassette 23 is inserted into body 15, CPU 232 detects whether there are paper sheets in upper cassette 23 (ST-A8).

If there are some paper sheets in upper cassette 23, CPU 232 assumes that upper cassette 23 is selected (ST-A9). This is because upper cassette 23 has the priority for paper feeding in the standard mode. That is, without the operation of cassette select key 123, the paper sheet P2 in upper cassette 23 is fed in a copying operation. Then, CPU 232 decides the size of the paper sheets P2 in upper cassette 23 (ST-A10).

In the step ST-A2, if there are no paper sheets in lower cassette 25, CPU 232 detects whether lower cassette 25 is designated through cassette select key 123 (ST-A11). If lower cassette 25 is not designated, CPU 232 goes to the step ST-A7.

In the step ST-A3, if upper cassette 25 is not inserted into body 15, CPU 232 checks whether or not lower cassette 25 is designated through cassette select key 123 on panel 17 (ST-A12). If lower cassette 25 is designated, CPU 232 jumps into the step ST-A6.

In the step ST-A7, if upper cassette 23 is not inserted, CPU 232 causes LCD 129 to display a message "ADD PAPER" and a symbol corresponding to the upper or lower cassette 23 or 25 (ST-A13). Then CPU 232 goes back to the step ST-A1.

In the step ST-A8, if there are no paper sheets in upper cassette 23, CPU 232 goes to the step ST-A13. In the step ST-A11, if lower cassette 25 is designated, CPU 232 goes to the step ST-A13.

Figure 15:
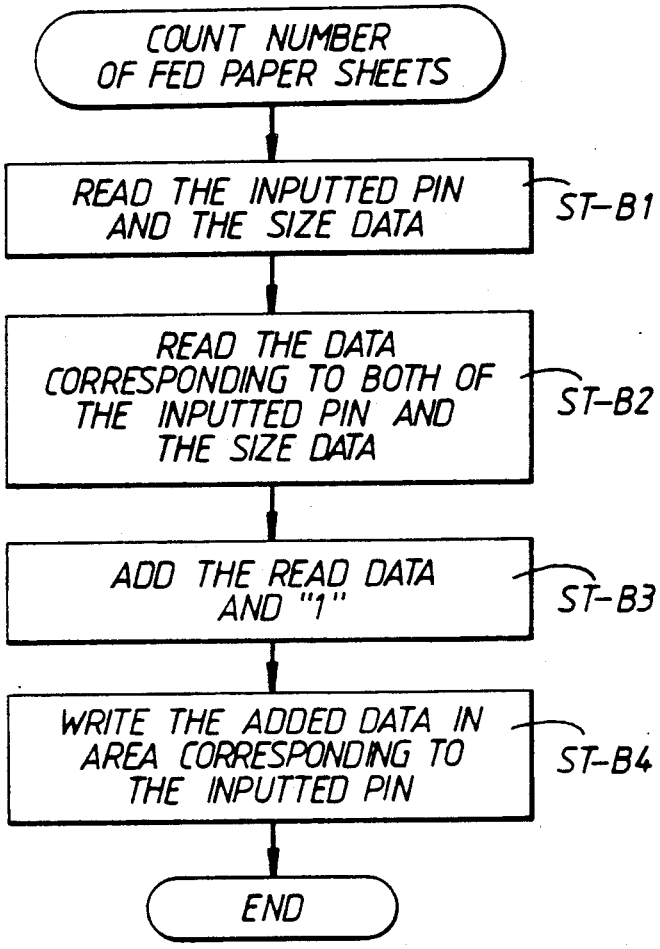
FIG. 15 is a flow chart illustrating the steps for counting the number of sheets fed by the feeding mechanism shown in FIG. 3.

Referring now to FIG. 15, the steps for counting the number of the fed paper sheets fed will be detailed.

CPU 232 reads the input PIN and the size data from the working memory (ST-B1). CPU 232 searches the area corresponding to the inputted PIN and the size data in first memory 323. Then, CPU 232 reads the data from the size area in first memory 323. The read data indicates the data relating to the number of paper sheets fed.

For example, user Mr. A, who has a PIN A, selects upper cassette 23, which accommodates paper sheets of ledger size. If Mr. A makes copy on the paper sheets of ledger size, CPU 232 checks whether or not PIN A is registered in third memory 329 and CPU 232 finds out PIN A in third memory 329 in the present example. Mr. B, on the other hand, does not have any PIN. If Mr. B inputs a random number, CPU 232 will fail to find the input number in third memory 329 so that the next succeeding steps fail to be performed. This processing is performed in the steps from ST-4 to ST-10.

After the step ST-B1, CPU 232 reads the data in the storing area corresponding to the input PIN and the selected size of paper sheets (ST-B2). This data represents the number of paper sheets used of a designated size. For example, in the case of above MR. A, CPU 232 reads the data in first storing area 401, especially, ledger area 401*b*. The data represents 1,000 (a thousand). That is, Mr. A has made 1,000 of copies on the paper sheets with the ledger size.

After to the step ST-B2, CPU 232 adds the number represented by the data and one so that the number of paper sheets used of the designated size is counted (ST-B3). For the example of Mr. A, CPU 232 adds 1,000 and 1 and CPU 232 gets 1,001, which is the present number of the used paper sheets with the ledger size by Mr. A.

After the step ST-B3, CPU 232 writes the new data in the same area as that read (ST-B4). That is, CPU 232 writes the new data into the area corresponding to the imputted PIN and the designated size. For the example of Mr. A, CPU 232 writes data representing 1,001 in the ledger area 401*b* in first memory 323.

According to the present embodiment, the counted number is output on LCD 129 or a paper sheet.

Figure 16A:
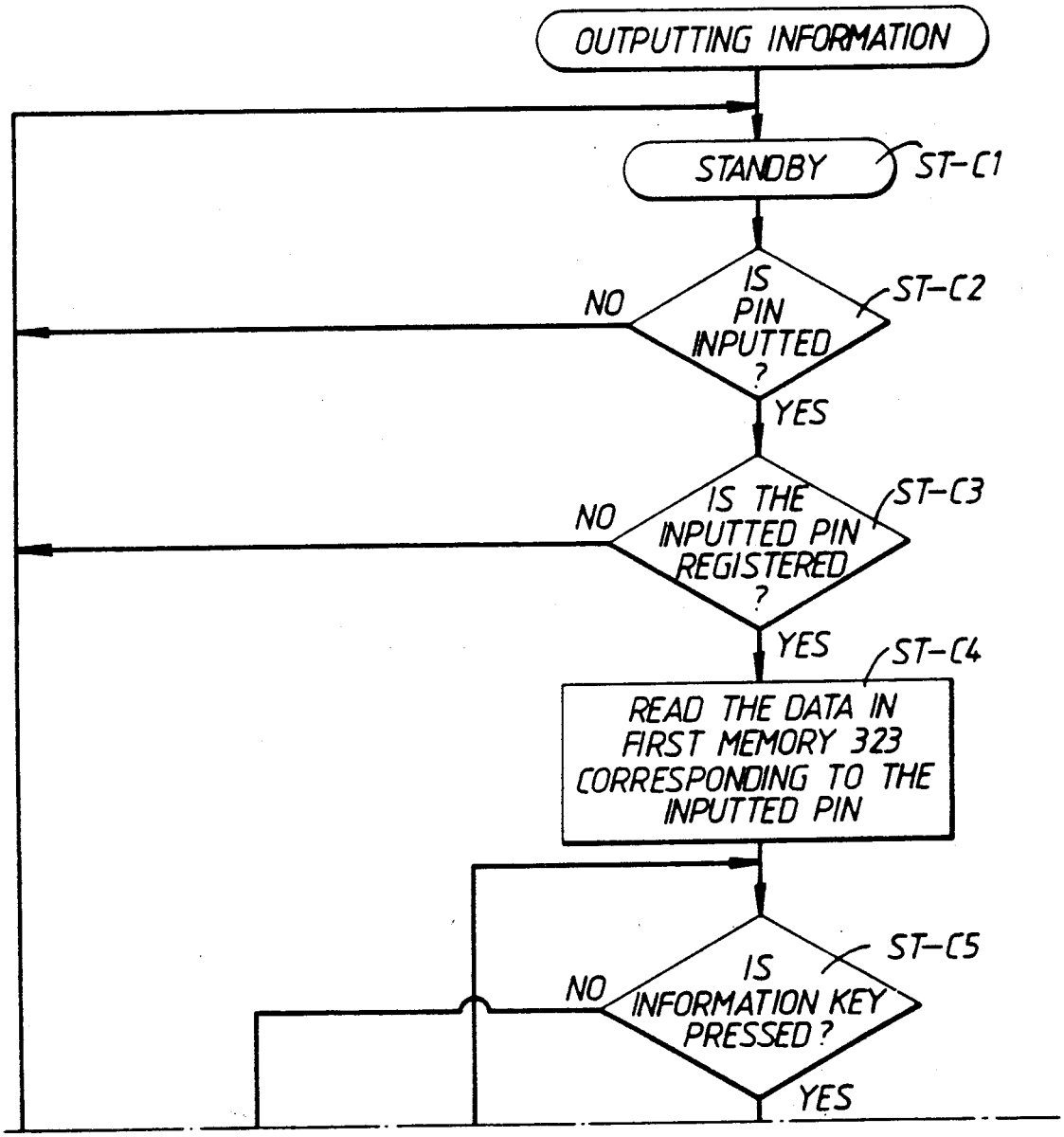
FIGS. 16A and 16B is a flow chart illustrating the steps for outputting information relating to the number of sheets fed, the size of the sheets, and a fee calculated from the number of paper sheets.
Figure 16B:
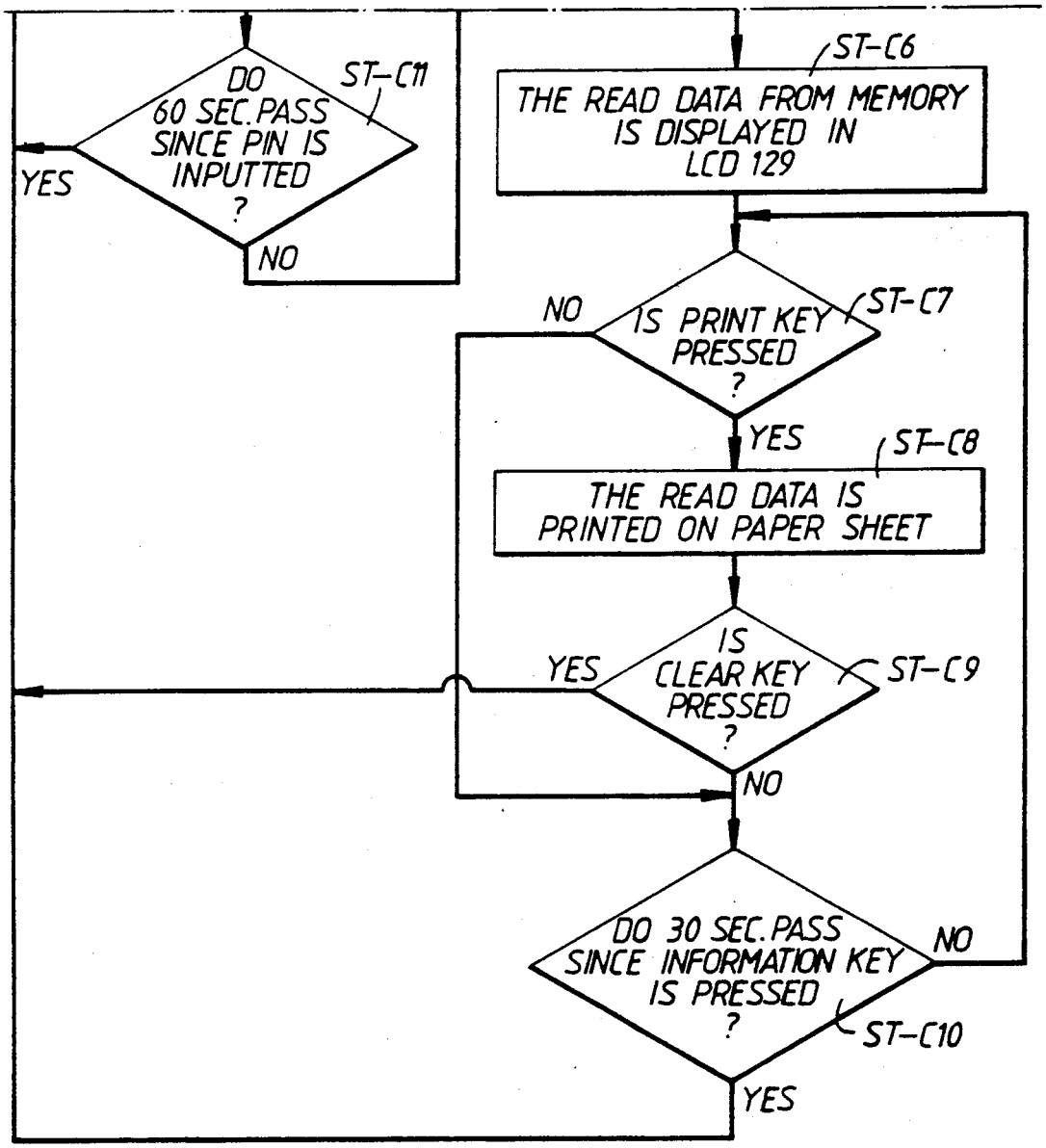

Referring now to FIG. 16, the steps for outputting the counted number will be detailed.

At first CPU 232 is in the standby condition (ST-C1). CPU 232 checks whether a PIN is inputted through digital keys 111 (See FIG. 2) (ST-C2). If a PIN is input, CPU 232 checks whether the input PIN is registered in third memory 329 (ST-C3). If the input PIN is registered, CPU 232 reads the data in the area corresponding to the input PIN (ST-C4).

Next, CPU 232 checks whether or not information key 131 (See FIG. 2) is pressed (ST-C5). If information key 131 is pressed, CPU 232 causes LCD 129 to display the data read at the step ST-C4 (ST-C6).

For the example of Mr. A, PIN A is inputted and then CPU 232 causes LCD 129 to display the data of Mr. A as shown in FIG. 17. According to the present embodiment, the number of paper sheets used and the copy fee are displayed in a first column 405 and a second column 409. Only the number of paper sheets used may be displayed as shown in FIG. 18, if the users know how much the copying fee is.

The counting steps for determining the fee will now be described. In the step ST-C4, CPU 232 reads the data in the area corresponding to the inputted PIN. This data represents the number of paper sheets used. CPU 232 reads the data in fee area 402. The data stored in fee area 402 represents the copy fee in accordance with the size of paper sheets. CPU 232 then calculates the copying fee in accordance with the size of the paper sheet.

Referring now to FIG. 16, after step ST-C6, CPU 232 checks whether print key 101 is pressed (ST-C7). If the print key 101 is pressed, CPU 232 causes writing unit 91 (see FIG. 23) to write the data displayed on LCD 129 (ST-C8)

Next, CPU 232 checks whether or not the clear/stop key 115 is pressed (ST-C9). If the clear/stop key 115 is not pressed, CPU 232 checks whether 30 seconds have passed since information key 131 was pressed (ST-C10). If 30 seconds have not passed, CPU 232 goes back to the step ST-C7. In the step ST-C2, if a PIN is not input, CPU 232 goes back to the step ST-C1. In the step ST-C3, if the input PIN is not registered, CPU 232 goes back to the step ST-C1. In the step ST-C5, if information key 131 is not pressed, CPU 232 checks whether 60 seconds have passed since a PIN was input (ST-C11). If 60 seconds have passed since a PIN was input, CPU 232 goes back to the step ST-C1.

In the step ST-C7, if print key 101 is not pressed, CPU 232 skips step ST-C10. In step ST-C9, if the clear/stop key 115 is pressed, CPU 232 goes back to step ST-C1.

According to the present embodiment, the operator is permitted to look at the fee information of all users. The steps for looking at the fee information of all users will be detailed.

Figure 19:
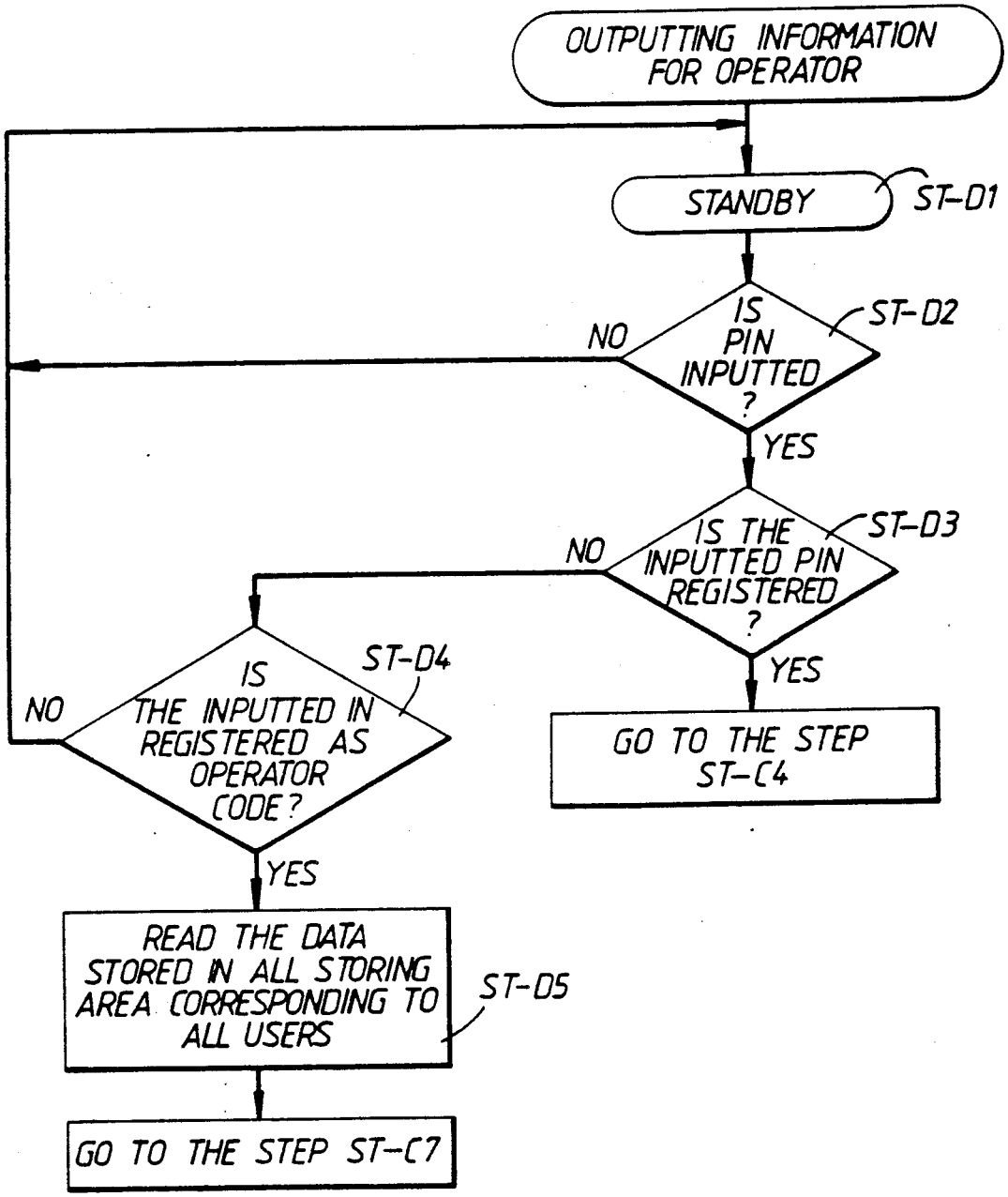
FIG. 19 is a flow chart illustrating the steps for outputting the operator's information relating to the number of the sheets fed, the size of the sheets, and a fee calculated from the number of the sheets.

Referring to FIG. 19, at first CPU 232 is in the standby condition (ST-D1). CPU 232 checks whether a PIN is input (ST-D2). If a PIN is input, CPU 232 checks whether the input PIN is registered (ST-D3). If the input PIN is registered, CPU 232 goes to step ST-C4, as shown in FIG. 16.

If the PIN is not registered, CPU 232 checks whether the input PIN is registered as an operator code (ST-D4) in first memory 323. If the inputted PIN is an operator code, CPU 232 reads the data stored in all storing areas corresponding to all users (ST-D5). Next, CPU 232 goes to the step ST-C7 as shown in FIG. 16 so that all information is written down on the paper sheet. The outputting is as shown for example, in FIG. 20. That is, the PIN, the size of paper sheets used, the number of paper sheets used, and the copying fee are output on the paper sheet P. The information on the paper sheet P may be limited to the PIN and the number of paper sheets used as shown in FIG. 21.

Furthermore it may be more desirable that the name corresponding to the PIN be substituted for the PIN on the paper sheet P, as shown in FIG. 22. This is because the PIN of others may be secret.

Figure 23:
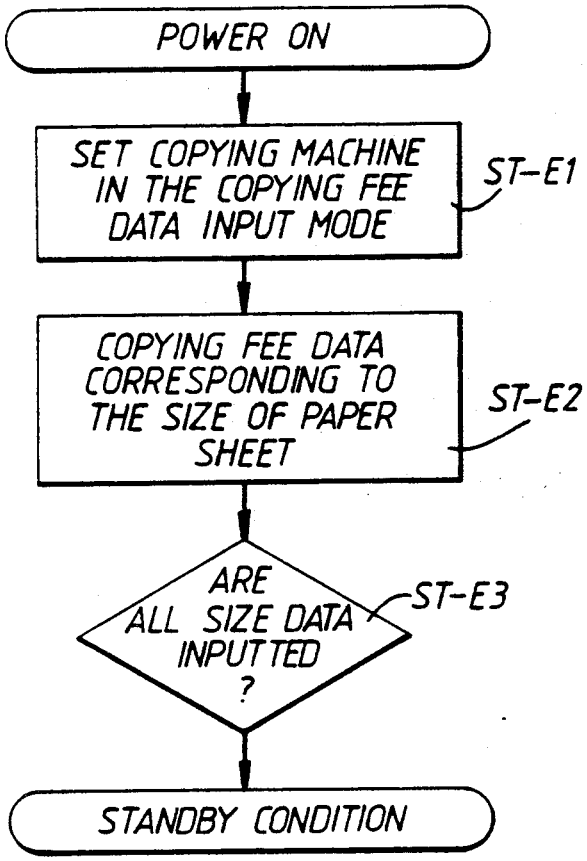
FIG. 23 is a flow chart illustrating the operation of changing the content of the first memory which is used in the circuit diagram shown in FIG. 11.
Figure 24:
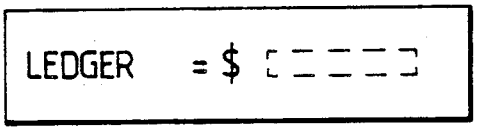
FIGS. 24, 25, 26, 27, 28 and 29 show illustrative displays of the liquid crystal display which is used in the steps shown in FIG. 23.
Figure 27:
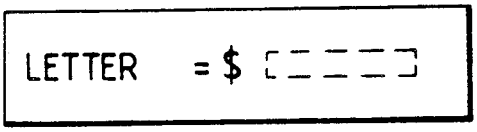
Figure 25:
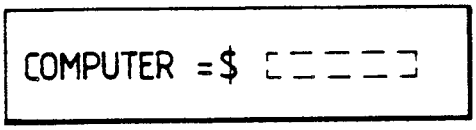
Figure 28:
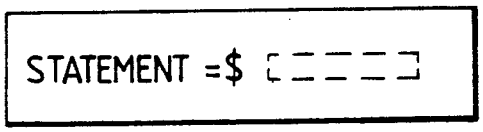
Figure 26:
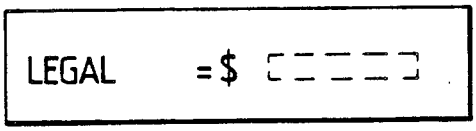
Figure 29:
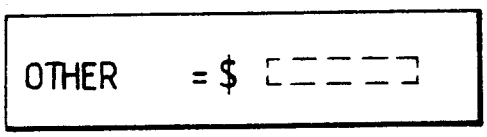

The operator may change the data stored in fee area 402 in first memory 323. Referring now to FIG. 23, after the power is turned on, the operator operates the predetermined combination of digital keys 111, e.g., "1" "2" "3", so that copying machine 11 is changed into a copying fee data input mode (ST-E1). That is, CPU 232 permits fee area 402 in first memory to be written into. CPU 232 causes LCD 129 to display a message indicating how much the copying fee per one paper of a specified size is. FIGS. 24 through 29 show the examples for a display in LCD 129. After the message is displayed, CPU 232 waits for the data to be input through digital keys 111 (ST-E2). That is, CPU 232 checks whether the data is input. If the data is input, CPU 232 checks whether all copying fee datum relating to the size of the paper sheets are input. (ST-E3).

For example, if there are five kinds of paper sizes, e.g., ledger, computer, legal, letter and statement, the steps ST-E2 and ST-E3 are repeated five times.

The data stored in third memory 329 may be changed only by the operator as described above. It is especially desirable that the content of third memory 329 is prepared in the factory or upon delivery of the copier and is not later changed through digital keys 111. This is because the PIN information stored in third memory 329 is used to distinguish between registered users and not-registered users.

Figure 30:
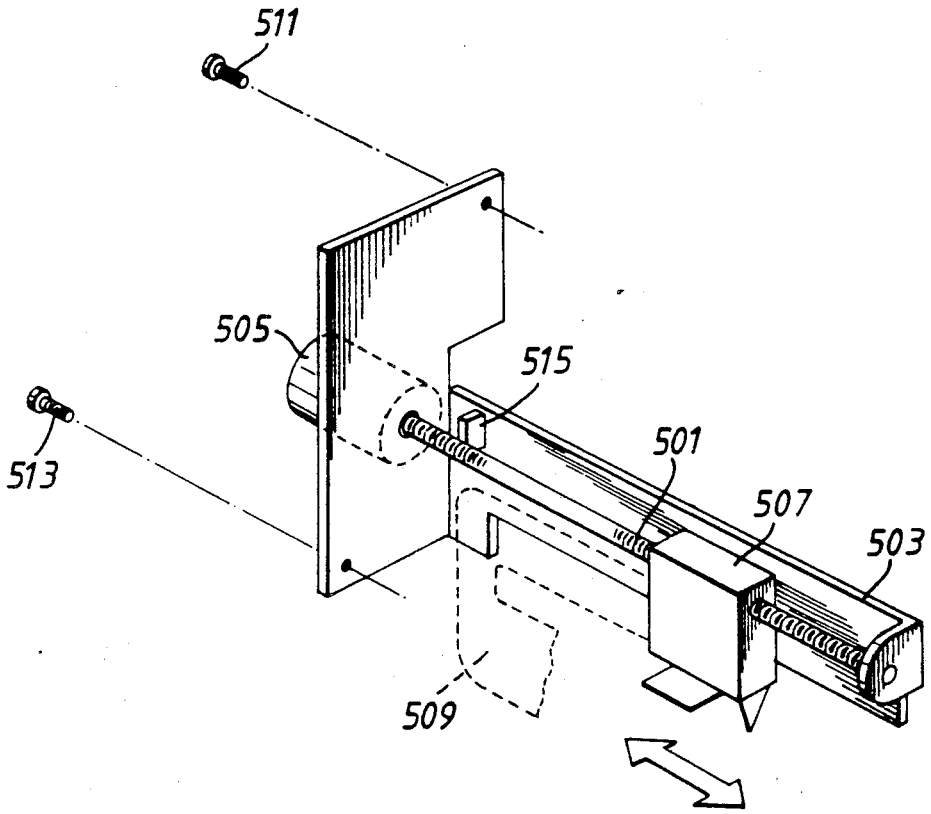
FIG. 30 is a perspective view of a writing unit which forms a part of the copying machine shown in FIG. 1.

Referring now to FIG. 30, the details of the writing unit 91 will be detailed. Writing unit 91 includes a screw 501 which is provided parallel to the rotating axis of photosensitive drum 29. One end of screw 501 is fixed to a frame 503. The other end is connected to a rotating axis of a pulse motor 505. A writing device 507 is hung on screw 501 through a female screw (not shown) of the writing device. Writing device 507 includes a plurality of LEDS (not shown) for emitting light in response to signals supplied from CPU 232 (see FIG. 9) through a flat cable 509. These elements including writing device 507 are detachably connected to body 15 through a panel and bolts 511 and 513. CPU 232 causes writing device 507 to move along screw 501 rotated by pulse motor 505 according to the format for writing the fee information as shown in FIGS. 17, 18, 20, 21 and 22. Furthermore CPU 232 controls the timing for suppling ON signals to writing device 507 so that light corresponding to the fee information is emitted and the latent image is made on the surface of phtosensitive drum 29. It is noted that CPU 232 supplies the signal representing the reverse image from character generator 321.

Figure 31:
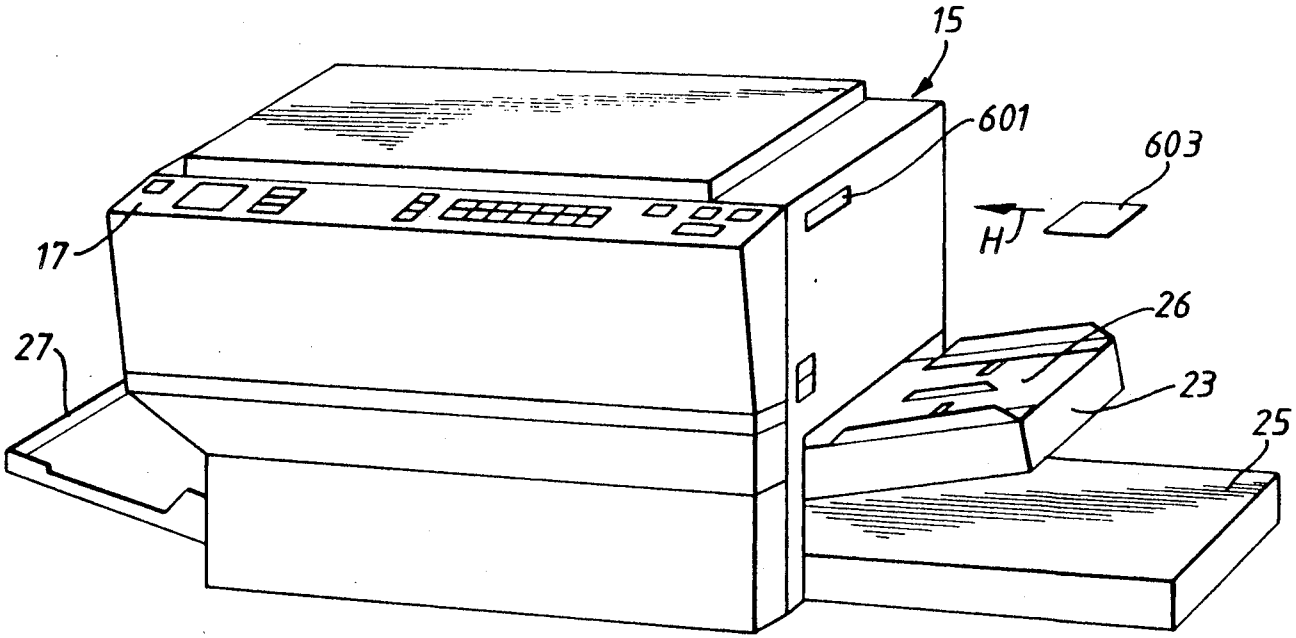
FIG. 31 is a perspective view of a copying apparatus according to another preferred embodiment, which permites an IC card to be used in the copying machine.

Writing unit 91 includes a position sensor 515, located at an initial position, for detecting whether or not writing device 507 is at the initial position. The initial position never faces the surface of photosensitive drum 29. In response to the detection signal of writing device 507, CPU 232 controls pulse motor 505 so that writing device 507 is moved to a position where the LED should emit light. CPU 232 then sends a driving signal to writing device 507 to cause it to emit light at that position. Referring now to FIG. 31, a second embodiment of the invention will be detailed. The difference between the first embodiment and the second embodiment is the memory means for storing information relating to the copying fee. Fundamentally the structure of the copying machine is the same as that described in connection with FIG. 1. Therefore, the reference numerals designating corresponding parts are the same as those in FIG. 1.

According to the present embodiment, copying machine 11 includes an inlet 601 for receiving an IC card 603.

Figure 32:
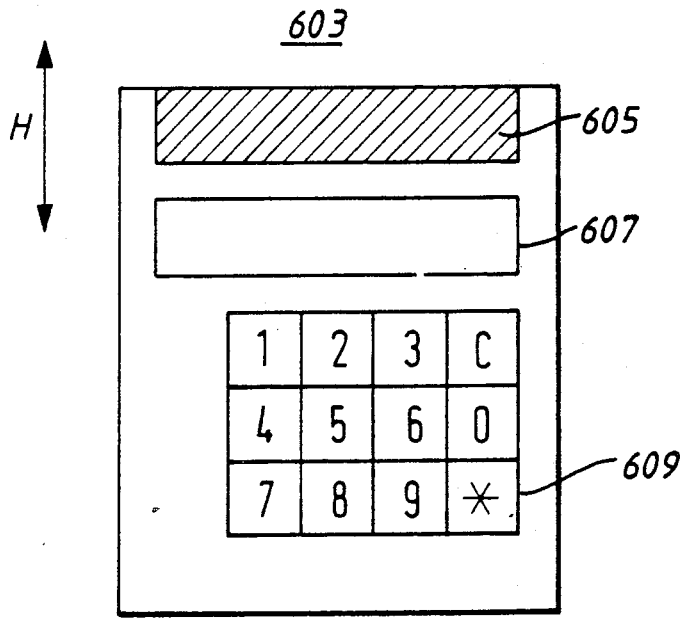
FIG. 32 is a plan view of the IC card which is used in the copying machine shown in FIG. 31.
Figure 33:
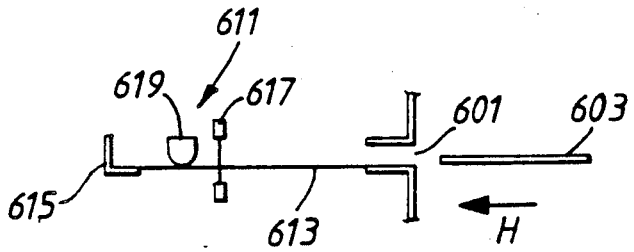
FIG. 33 is a sectional view of a portion of the copying machine relating to the IC card shown in FIG. 32.

Referring now to FIG. 32, IC card 603 includes a connecting part 605 for electrically connecting IC card 603 with copying machine. IC card 603 includes a card display 607 for displaying information which is received from CPU 232 in copying machine 11 or which is input through digital keys 609, provided on IC card 603, for inputting numbers thereby. Referring now to FIG. 33, IC card 603 is inserted into body 15 through inlet 601 along the direction indicated by the arrow H as shown in FIGS. 31, 32 and 33. Inlet 601 leads to a writing/reading device 611 for writing or reading data in or from IC card 603. Writing/reading device 611 includes a path 613 along which IC card 603 is inserted. IC card 603 is stopped by a stopper 615, which is located at the interior of writing/reading device 611, for positioning IC card 603 at predetermined position.

A detector 617, provided on path 613, detects whether IC card 603 is inserted along path 613 and is located at the predetermined position. After IC card 603 is inserted at the predetermined position, a head 619 writes or reads data in or from IC card 603 through connecting part 605.

Figure 34:
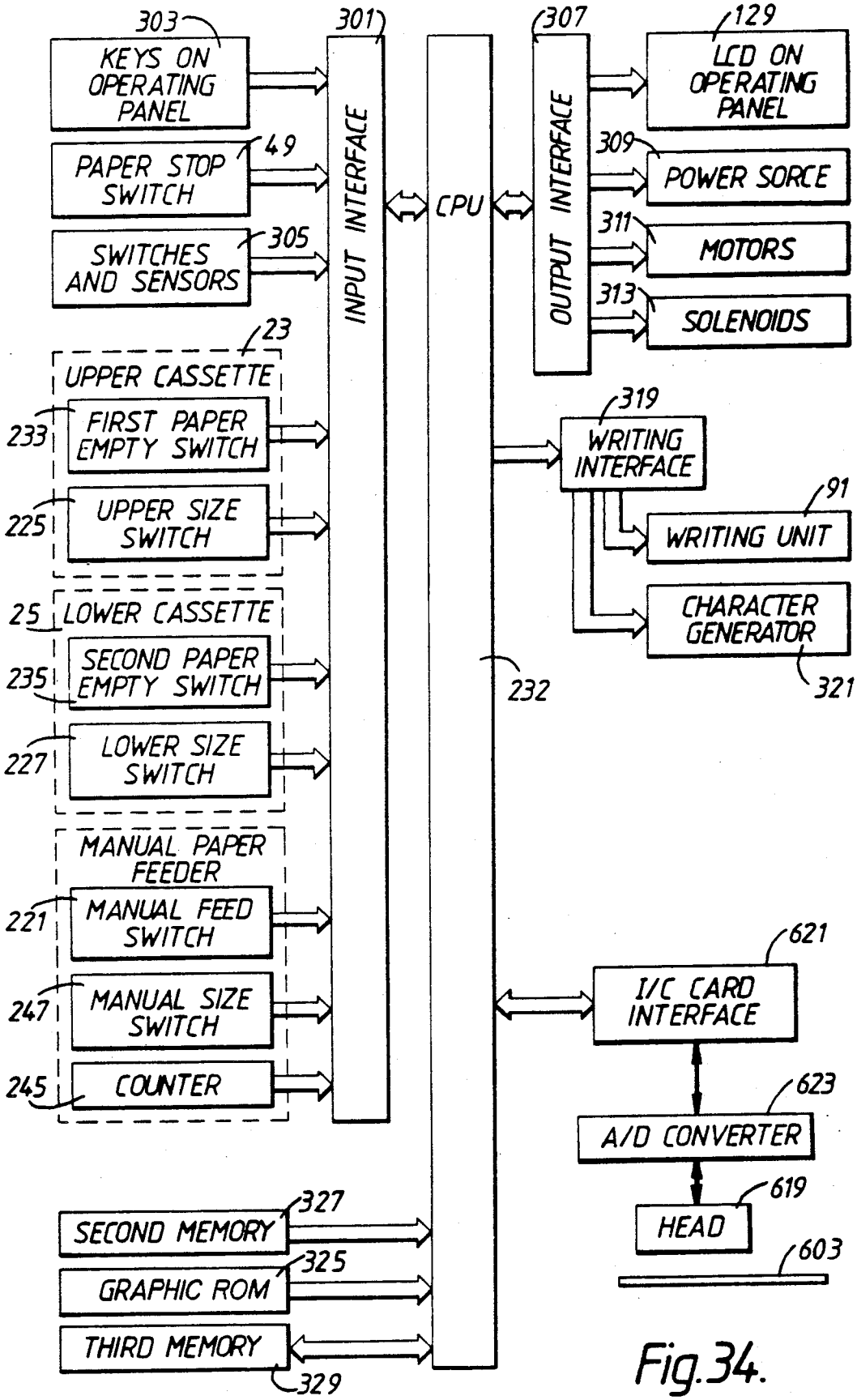
FIG. 34 is a circuit diagram of the copying machine shown in FIG. 31.

Referring now to FIG. 34, the electrical structure of copying machine 11 according to the present embodiment will be detailed.

Head 619 is connected to CPU 232 through an IC card interface 621 and an A/D converter 623. Head 619 writes or reads information using analogue signals so that A/D converter 623 converts analogue to digital signals and vice-versa The difference between the electrical structure of the first embodiment shown in FIG. 9 and that of the present embodiment shown in FIG. 34 is that IC card 603 is substituted for first memory 323. As is well known, IC card 603 has a CPU (not shown) and memory 701 which is controlled by the CPU.

Referring now to FIG. 35, IC card 603 has a memory 701, provided inside IC card 603, for storing the fee data. Memory 701 includes a PIN area 703 for storing PIN data for a card holder. Memory 701 includes a first fee area 705 for storing the data relating to the copying fee per one copy, total copying fee, the number of paper sheets used at the present time and the total number of paper sheets used of the ledger size. The copying fee data from each copying session may be stored in first fee area 705.

Furthermore, memory 701 includes a second, a third, a fourth and a fifth fee area 707, 709, 711 and 713 for the computer size, the legal size, the letter size and the statement size, respectively. Memory 701 includes a memo area 715 for storing data other than that described above, e.g., total a copying fee for all paper sizes.

Figure 36A:
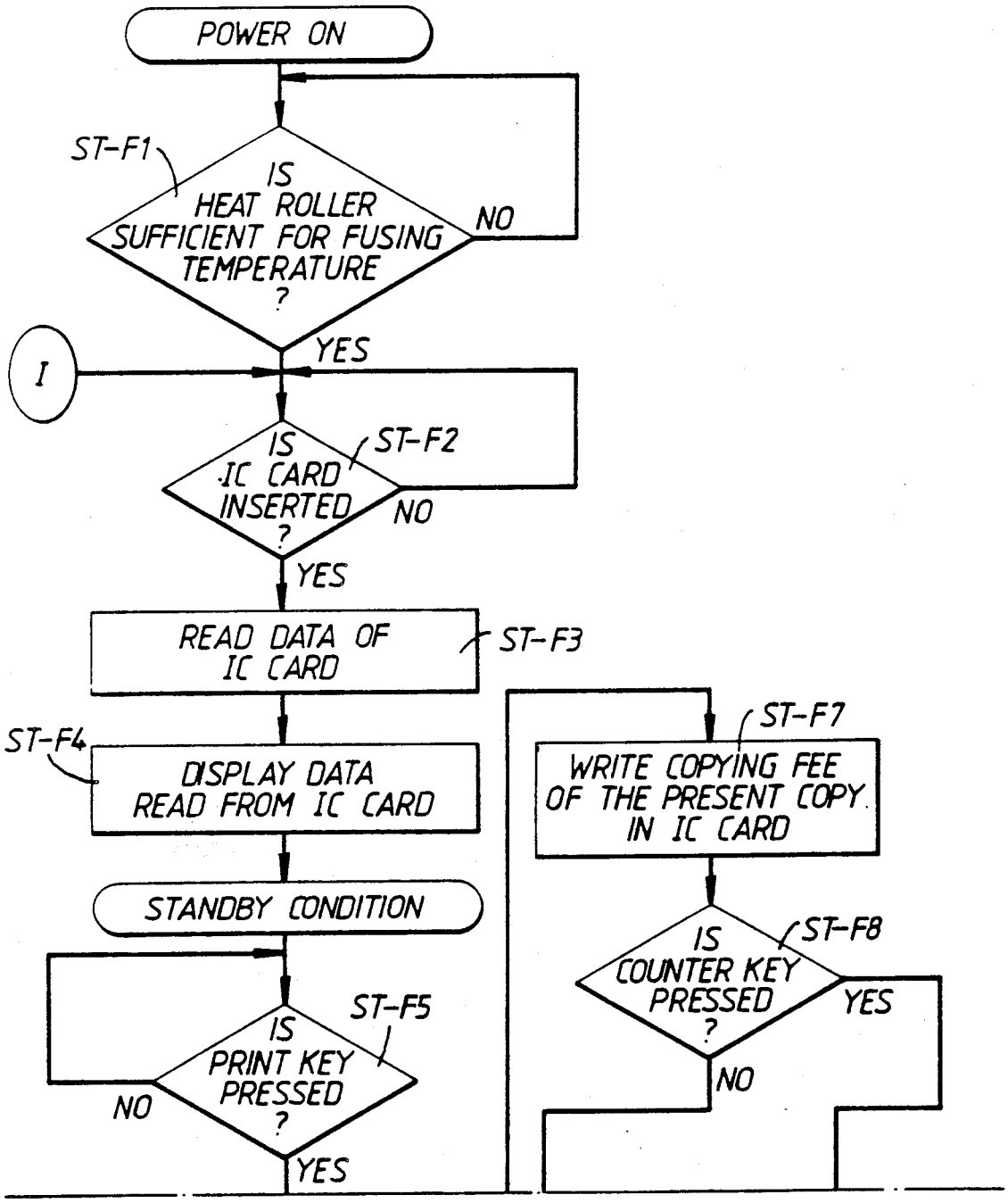
FIGS. 36A and 36B is a flow chart illustrating the operation of the IC card shown in FIG. 32.
Figure 36B:
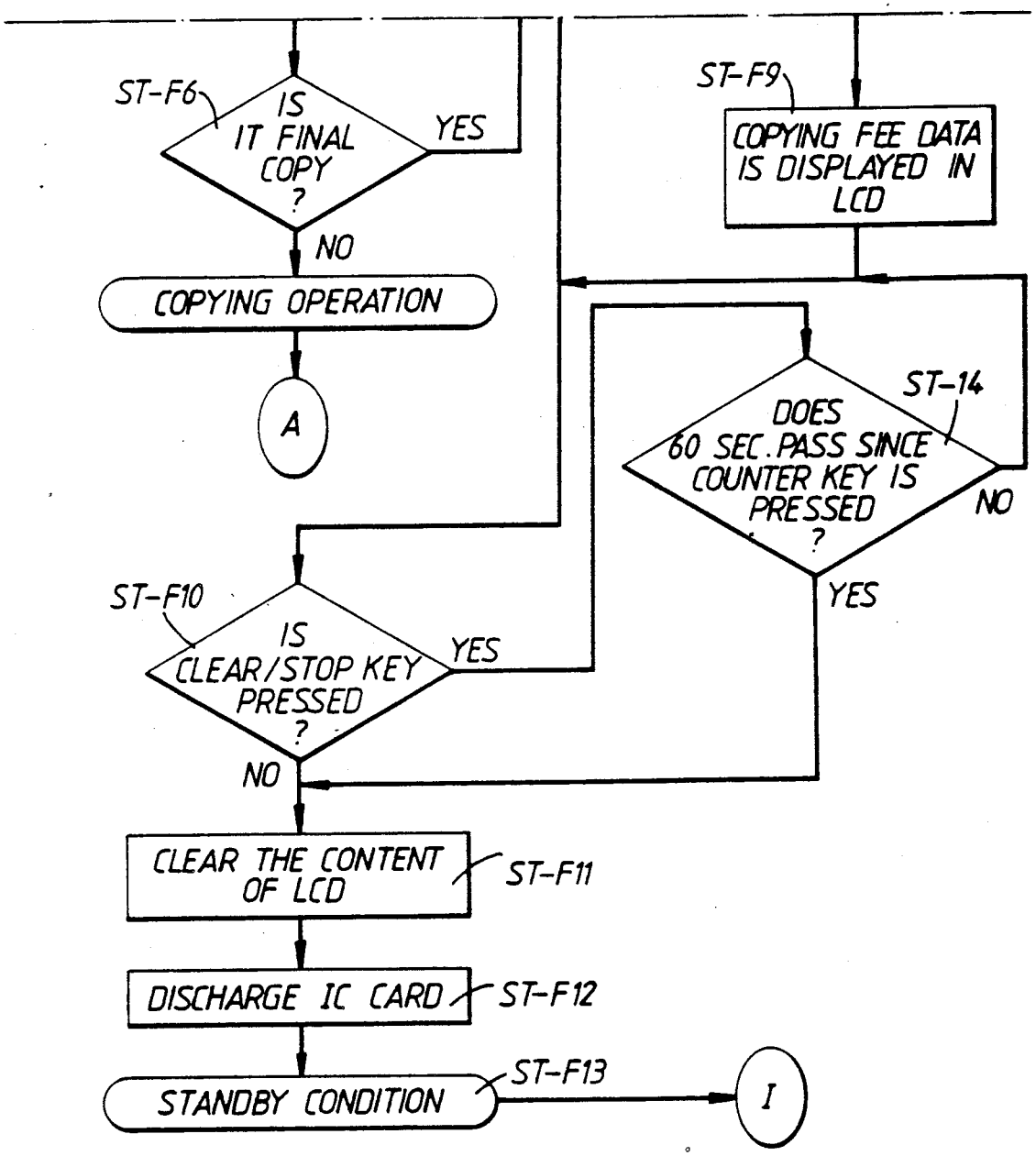

Referring now to FIG. 36, the operation of copying machine 11 will be detailed.

After power source 309 is turned on, CPU 232 checks whether or not heat roller 53 is heated enough to fix the toner image (ST-F1). If heat roller 53 is heated enough, CPU 232 checks whether IC card 603 is inserted into body 15 (ST-F2) by using the output signal from detector 617. When the user makes a copy, the user inputs his PIN into IC card 603 through digital keys 609. The input PIN is stored in a working memory (not shown). If IC card 603 is inserted, CPU 232 reads the data stored in PIN area 703 and the input PIN stored in the working memory (ST-F3). CPU 232 checks whether the input PIN is the same as that stored in PIN area 705. If the input PIN is not the same as that stored in PIN area 705, CPU 232 does not proceed to the succeeding steps. If the input PIN is the same as that stored in PIN area 705, CPU 232 goes to the following steps.

CPU 232 reads the data relating to the total copying fee irrespective of the paper size and then displays that data (ST-F4). This is because the user may wish to confirm the total copying fee and the remaining fee to be used. If IC card 603 is assigned a limited copying fee indicating the maximum fee within which the user is permitted to copy with the IC card 603, CPU 232 checks whether or not the total copying fee is over the limited copying fee. In the standby condition after the step ST-F4, the CPU checks whether print key 101 is pressed (ST-F5). If print key 101 is pressed, CPU 232 checks whether the copying operation is finished (ST-F6). If the copying operation is finished, CPU 232 writes the data relating to the total copying fee, the number of paper sheets used at the present copying time, and the total number of paper sheets used at locations 705, 707, 709, 711 and 713, corresponding to the size of the paper sheets used (ST-F7).

After writing, CPU 232 checks whether counter key 107 is pressed (ST-F8). If the counter key 107 is pressed, CPU 232 causes LCD 129 to display the copying fee data in LCD 129 (ST-F9).

Next, the CPU 232 checks whether or not clear/stop key 115 is pressed (S7-F10). If the clear/stop key 115 is pressed, CPU 232 clears the content of LCD 119 (S7-F11), discharges IC card 603 from body 15 through inlet 601 (ST-F12), and then goes into the standby condition (ST-F13).

In step ST-F6, if the copying operation is not finished, CPU 232 continues the copying operation using the steps shown in FIG. 11.

In the step ST-F8, if counter key 107 is not pressed, CPU 232 goes to the step ST-F10. In the step ST-F10, if clear/stop key 115 is not pressed, CPU 232 checks whether 60 seconds have passed since counter key 107 was pressed (ST-F14). If 60 seconds have not passed, CPU 232 goes back to the step ST-F10. If 60 seconds have passed, CPU 232 goes to the step ST-F11.

Figure 37:
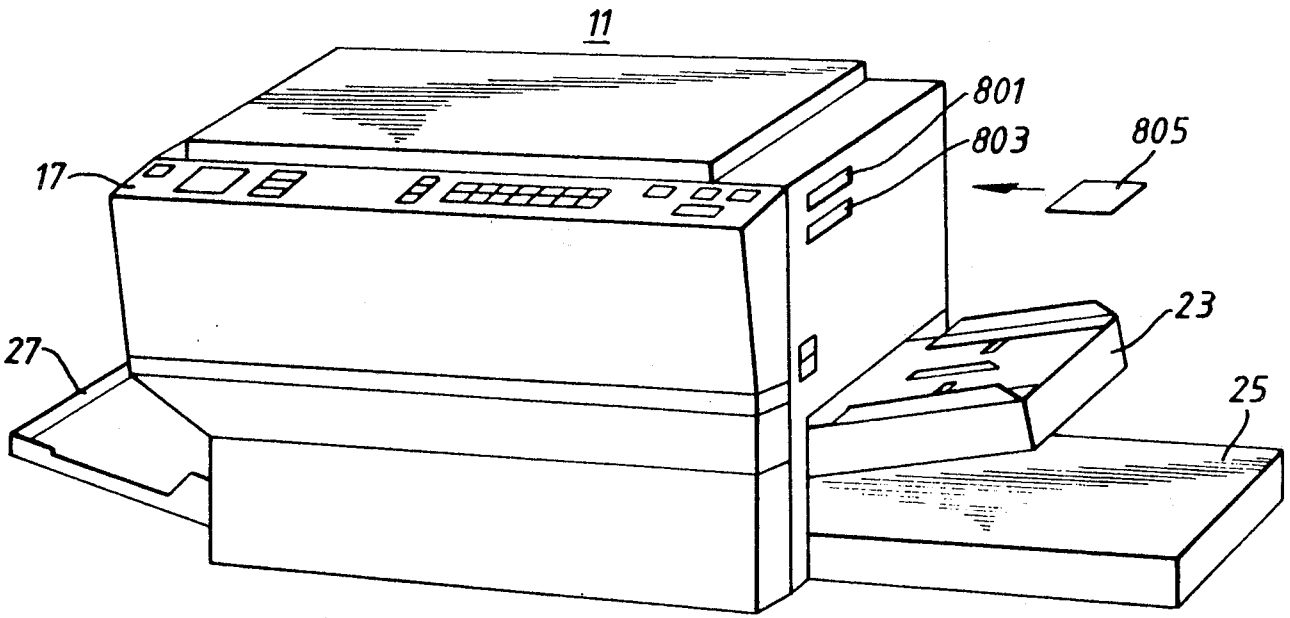
FIG. 37 is a perspective view of a copying machine according to a third embodiment.

Referring now to FIG. 37, yet another embodiment of the present invention will be detailed.

The difference between the second embodiment and the present embodiment is that a magnetic card is substituted for IC card 603 as shown in FIG. 32. Fundamentally, the copying machine is the same as that shown in FIG. 1. Therefore the reference numerals designating corresponding parts are the same as those in FIG. 1.

Figure 39:
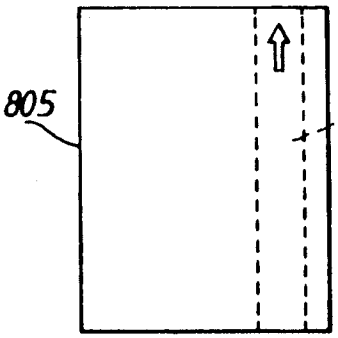
FIGS. 38 and 39 show a magnetic card which is used in the copying machine shown in FIG. 37.
Figure 38:
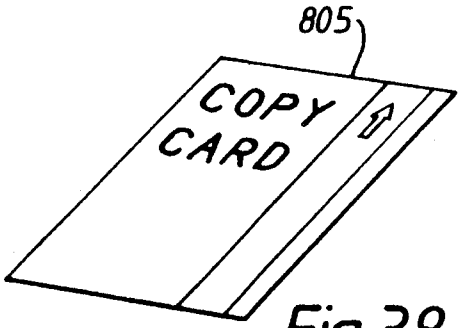

Copying machine 11 has two inlets 801 and 803 for receiving a magnetic card 805. Referring now to FIGS. 38 and 39, magnetic card 805 comprises a plastic card having a magnetic strip 807 for storing the data relating to the copying fee. Specially, magnetic strip 807 stores the data relating to the maximum copying fee within which the user may use copying machine 11. The maximum copying fee may be set at 100 dollars, 1,000 dollars and so on. According to the present embodiment, if the remaining value on one card is small, two magnetic cards 805 may be inserted succeedingly through two inlets 801 and 803.

Figure 40:
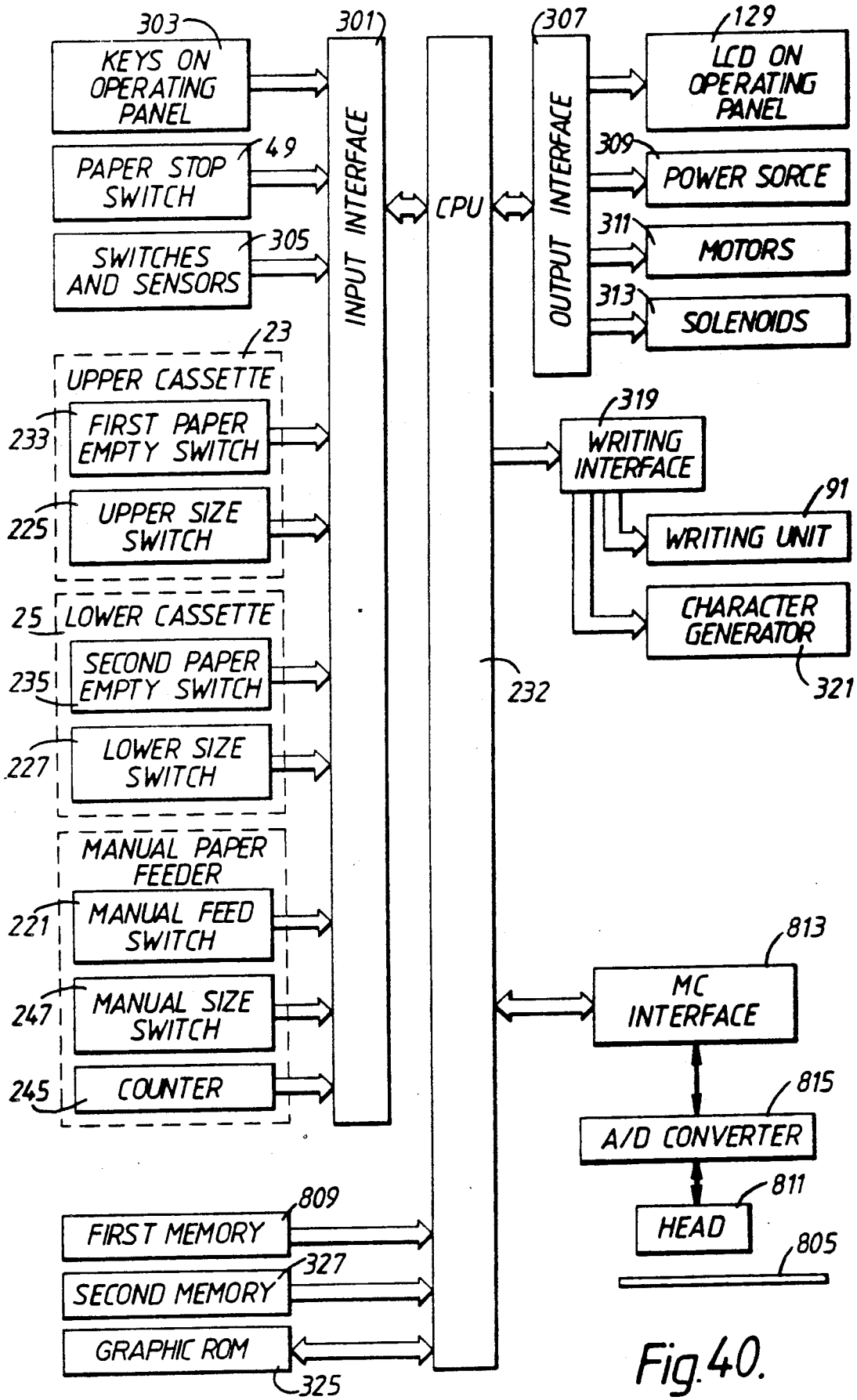
FIG. 40 is a circuit diagram of the copying machine shown in FIG. 37.

Referring now to FIG. 40, the electrical struture of copying machine 11 will be detailed.

The difference between the electrical structure of the second embodiment shown in FIG. 34 and that of the present embodiment is that magnetic card 805 is substituted for IC card 603 and the data relating to the copying fee irrespective of the users is stored in fourth memory 809. The data relating to the copying fee in accordance with the particular user is stored in magnetic card 805.

The data stored in magnetic card 805 is read or written by a magnetic head 811 which is connected to CPU 232 through a magnetic card interface (referred to as MC interface in FIG. 40) 813 and an A/D converter 815.

Referring now to FIG. 41, fourth memory 809 comprises a first fee area 817 for storing data relating to the copying fee for paper sheets of ledger size irrespective of the user. A second, a third, a fourth and fifth fee areas 819, 821, 823 and 825 are provided for the computer size, the legal size, the letter size and the statement size irrespective of the user. The copying fee for each user is stored in magnetic card 805.

According to the present embodiment, CPU 232 causes LCD 129 to display the remaining value on magnetic card 805 in response to the operation of information key 131 (See FIG. 2). The copying fee for copies made is calculated by the steps described in the first embodiment.

Figure 42:
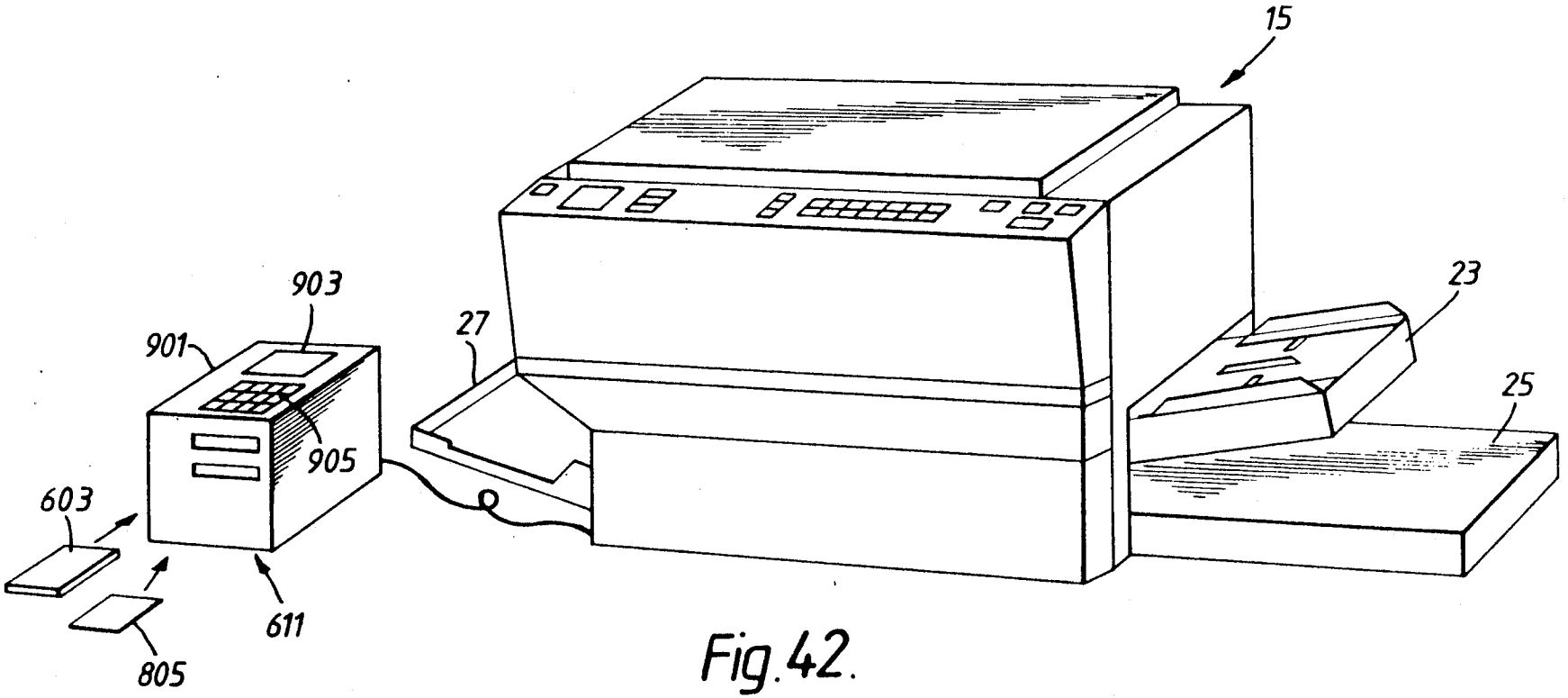
FIG. 42 is a perspective view of a copying machine according to a fourth embodiment.

Referring now to FIG. 42, another embodiment of the present embodiment will be detailed. According to the present embodiment, a writing/reading device 611 may be provided apart from body 15.

Writing/reading device 611 includes a body 901 on which a display 903 and digital keys 905 are provided. Writing/device 611 has two inlets 907 and 909 for receiving IC card 603 and magnetic card 805 respectively The display format and the content of LCD 129 is not limited to that of the above embodiments. For example, as shown in FIGS. 43A through 43F, the copying fee data may be shown in succeeding steps in LCD 129 in accordance with the size of paper sheets used in response to the operation of counter key 107.

Referring now to FIGS. 44A and 44B, the copying fee may be displayed along with a symbol 951 indicating the size of the sheet selected for copying.

What is claimed is:

1. An image forming apparatus including an apparatus for feeding a variety of sheet materials and calculating a user fee corresponding to the kinds and the number of sheets fed, the image forming apparatus comprising:

storing means for storing a plurality of kinds of the sheet material;

feeding means for feeding selected kinds of the sheet material;

image forming means for forming an image on the sheet material fed by the feeding means;

counting means for respectively detecting the number and the kinds of sheets fed by the feeding means;

means for calculating a user fee corresponding to the number and kinds of sheets detected by the counting means; and means for printing the user fee on the sheet material by using the image forming means.

2. An image forming apparatus comprising:

means for storing a plurality of kinds of sheet material;

means for feeding selected kinds of the sheet material;

means for respectively counting the number and the kinds of sheets fed by the feeding means;

means for discriminating user codes each corresponding to at least first and second users;

first memory means for storing the number and the kinds of sheets counted by the counting means corresponding to the first user;

second memory means for storing the number and the kinds of sheets counted by the counting means corresponding to the second user;

means for calculating a user fee corresponding to the first and second user codes by using the number and kinds of sheets stored in the first and second memory means; and means for forming an image on the sheet material fed by the feeding means and for printing the user fee calculated by the calculating means on the sheet material fed by the feeding means.

* * * * *